United States Patent [19]

Codding

[11] Patent Number: 4,697,709

[45] Date of Patent: Oct. 6, 1987

[54] SORTER FOR AGRICULTURAL PRODUCTS

[75] Inventor: Elias H. Codding, Houston, Tex.

[73] Assignee: Delta Technology Corporation, Houston, Tex.

[21] Appl. No.: 772,178

[22] Filed: Sep. 3, 1985

[51] Int. Cl.[4] ..... B07C 5/342

[52] U.S. Cl. ..... 209/549; 209/581; 209/589; 209/639; 250/226

[58] Field of Search ..... 209/546, 548, 549, 551, 209/576, 577, 580, 581, 587, 639, 563–565, 582; 250/205, 214 AG, 226; 315/151, 307, 360, 361

[56] References Cited

U.S. PATENT DOCUMENTS

| | | | |
|---|---|---|---|
| 2,726,762 | 12/1955 | Aubry | 209/581 |
| 3,028,960 | 4/1962 | Currie et al. | 209/580 X |
| 3,215,843 | 11/1965 | Neil | 250/205 |
| 3,373,870 | 3/1968 | Black et al. | 209/582 X |
| 3,558,892 | 1/1971 | Seeley | 250/205 |
| 3,700,960 | 10/1972 | Lake | 315/151 |
| 3,712,469 | 1/1973 | Dwyer et al. | 209/580 X |
| 3,738,484 | 6/1973 | Hoover et al. | 209/581 |
| 3,776,381 | 12/1973 | Wood | 209/581 X |
| 3,833,761 | 9/1974 | Houck | 315/307 X |
| 3,890,540 | 6/1975 | Ott | 315/335 |
| 3,944,819 | 3/1976 | Sherwood | 209/580 X |
| 4,012,663 | 3/1977 | Soileau | 315/151 |
| 4,061,925 | 12/1977 | van der Gaag et al. | 250/214 AG X |
| 4,208,578 | 6/1980 | McLoughlin et al. | 250/214 AG |
| 4,385,262 | 5/1983 | Cambier etal. | 315/307 |
| 4,454,029 | 6/1984 | Codding | 209/581 |
| 4,513,868 | 4/1985 | Culling et al. | 209/581 |
| 4,537,510 | 8/1985 | Takahasi | 250/214 AG X |
| 4,626,677 | 12/1986 | Browne | 209/580 |

FOREIGN PATENT DOCUMENTS

| | | | |
|---|---|---|---|
| 1461387 | 1/1977 | United Kingdom | 250/214 AG |
| 2091415 | 7/1982 | United Kingdom | 209/576 |
| 2136957 | 9/1984 | United Kingdom | 209/580 |

*Primary Examiner*—Randolph A. Reese
*Assistant Examiner*—Edward M. Wacyra
*Attorney, Agent, or Firm*—Pravel, Gambrell, Hewitt, Kimball, & Krieger

[57] ABSTRACT

A sorter is provided for sorting unacceptable agricultural products from acceptable ones. The sorter is preferably a monochromatic one performed as the products pass in streams past an illuminated viewing station. The view station includes a plurality of optical stations, each composed of a plurality of aligned optical sensors. The optical sensors sense the reflected light from the stream of product passing the optical station and form electrical signals indicative of the sensed light. The electrical signals from the sensors in individual optical stations are sequentially sampled or multiplexed at a rate which permits the product to pass through the viewing station at an increased volume, rather than in serial fashion, increasing the productivity of the sorting operation. Unacceptable products are ejected as they are sensed. The ejected product stream is subjected to a second sort to increase sort accuracy.

22 Claims, 23 Drawing Figures

SORTER FOR AGRICULTURAL PRODUCTS

BACKGROUND OF INVENTION

1. Field of the Invention

The present invention relates to optical sorting machines for agricultural products.

2. Description of the Prior Art

U.S. Pat. No. 4,454,029, of which applicant is inventor, relates to a bichromatic sorter for agricultural products. These sorters have been primarily used to detect unacceptable agricultural products based on color of the product, such as coffee beans, peanuts and the like. There were certain types of relatively smaller, usually granular, agricultural products, such as rice grains which required only a monochromatic or gray level sort to reject unacceptable dark products. U.S. Pat. No. 3,738,484 related to a sorter for monochromatic sorting of this type. However, it was felt that the grains had to be maintained in serial flowing streams of spaced individual grains for accurate sorting. This placed an effective limit on the volume of grains which a sorter could process in a particular time interval. For increased productivity, additional sorters were required.

SUMMARY OF INVENTION

Briefly, the present invention provides a new and improved sorter for agricultural products, particularly small granular ones such as rice and the like. The products are sorted based on their illumination intensity as they fall in streams past an illuminated viewing chamber. The products are formed into a number of parallel, downwardly falling streams before passing into the viewing station. In these streams, there is no need to separate and scan each individual grain of product singly. Thus, sorter productivity is increased, while also increasing sort accuracy. A number of channels of optical scanning stations of like number to the number of falling streams of product are located in the viewing chamber. The streams of product are illuminated by fluorescent lamps in the viewing chamber and the amount of light reflected by the streams of falling product is sensed, usually monochromatically, and detected unacceptable products are ejected.

Each of the optical scanning stations takes the form of a plurality of aligned optical sensors to sense a subdivided portion of the area of the viewing chamber before the scanning station. The optical sensors form electrical signals indicative of the sensed light from the product, if any, present before it. The signals from the optical sensors for each individual channel are sequentially sampled or multiplexed and provided to an electronic processing circuit for comparison with a reference signal to determine if the products are acceptable. If not, they are ejected.

By subdividing the image area present before an optical viewing station channel into a number of areas, one for each optical sensor, and by sequentially scanning them in multiplex fashion, sorting rates and productivity are materially increased, while also affording an increase in sorting accuracy. Further, there is no need to separate the product into serial falling streams of spaced individual grains.

In addition to the fluorescent lamps which provide main illumination of the product, a background fluorescent lamp is provided to form a background illumination level for the viewing chamber. The sensitivity of the lamps is adjustable. Once set, it is automatically monitored and controlled. The intensity of the current driving each fluorescent lamp is also monitored and compared against its maximum rated value. If actual current through a lamp exceeds its rated value, an indication of this is provided.

The sorter of the present invention operates under control of timing circuitry which periodically turns off the fluorescent illuminating lamps and reverses the polarity of the voltage applied to them. During the same time interval that lamp polarity is reversed, the viewing chamber can be automatically subjected to a burst of air to clear any dust or particulate matter which may be present.

In a preferred embodiment, a sorter according to the present invention takes the form of two identical sorters, one located above the other. The lower sorter receives only the product ejected by the upper sorter as unacceptable, and retrieves a substantial percentage of acceptable product from the grain provided it.

DESCRIPTION OF PREFERRED EMBODIMENT

Figure 1:
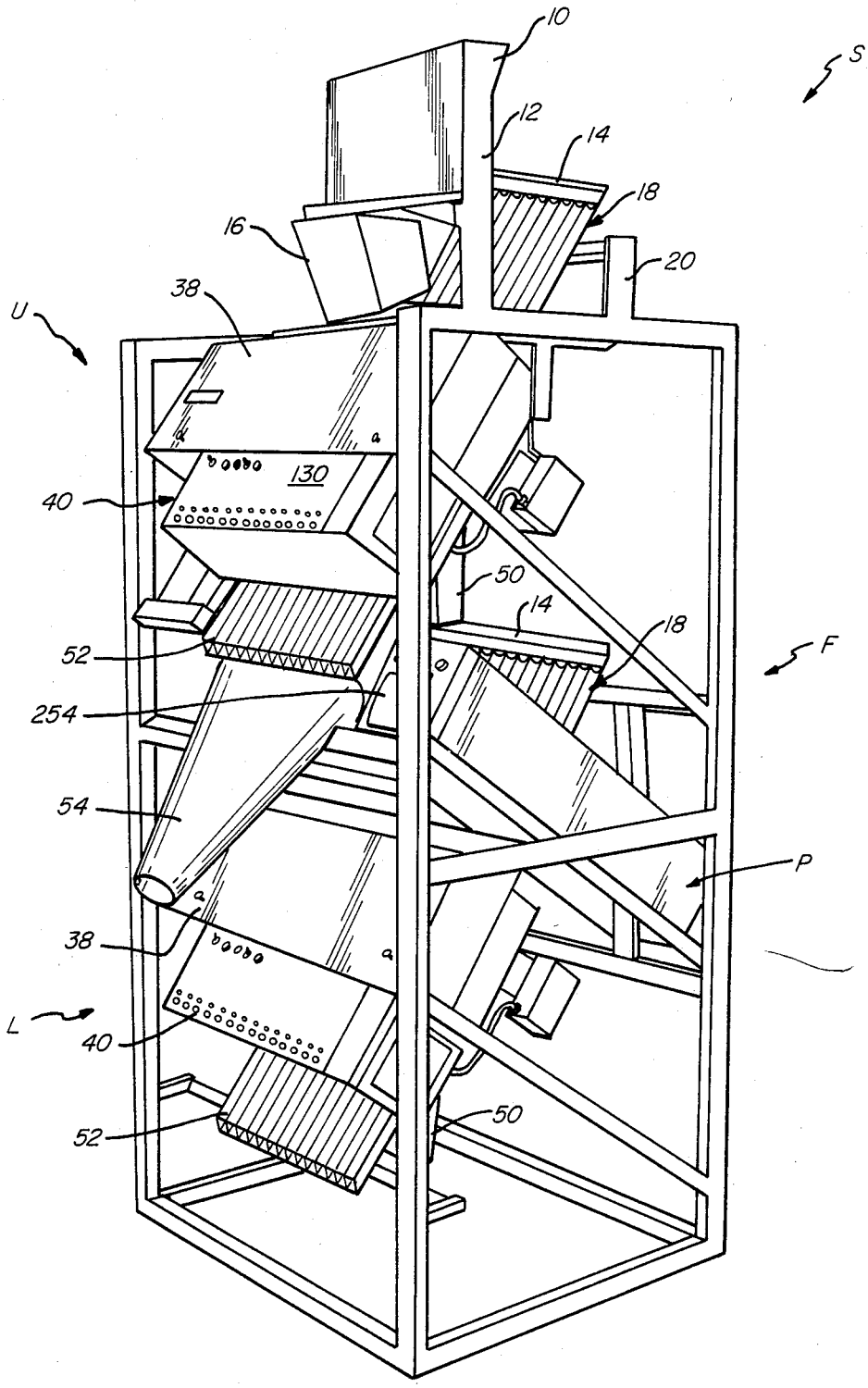
FIG. 1 is an isometric view of a sorter according to the present invention.

In the drawings, the letter S (FIG. 1) designates generally a sorting machine according to the present invention for sorting small, granular agricultural products, such as rice grains and the like. The sorting machine S includes an upper sorter U and a lower sorter L mounted on a frame F. A power supply P (FIGS. 1 and 15) is provided on the frame F to produce operating electrical power and suitable bias voltages to the sorters U and L. The sorters U and L, other than their location on the framework F are of similar construction and operation. Accordingly, details of only one will be set forth, it being understood that the other is of similar structure and function.

Figure 2:
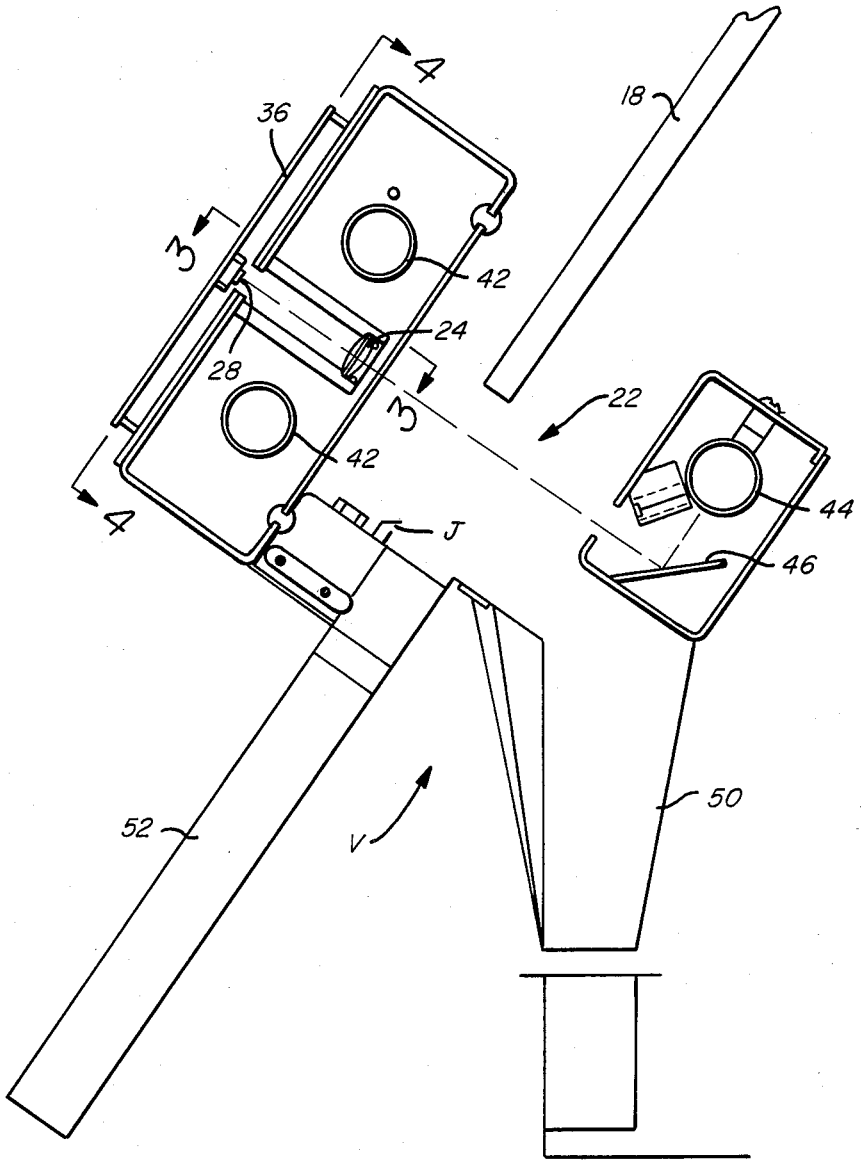
FIG. 2 is an elevation view, taken partly in cross-section, of a product viewing station in the sorter of FIG. 1.
Figure 3:
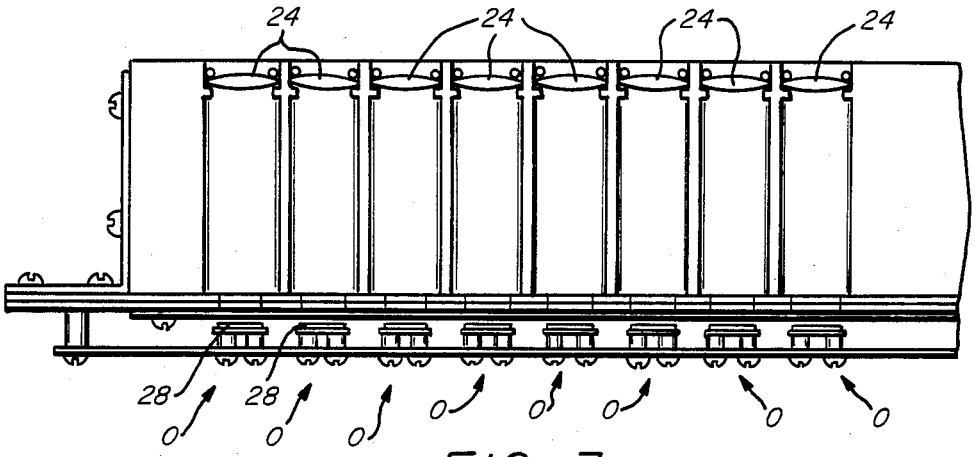
FIG. 3 is a cross-sectional view taken along the line 3—3 of FIG. 2.
Figure 4:
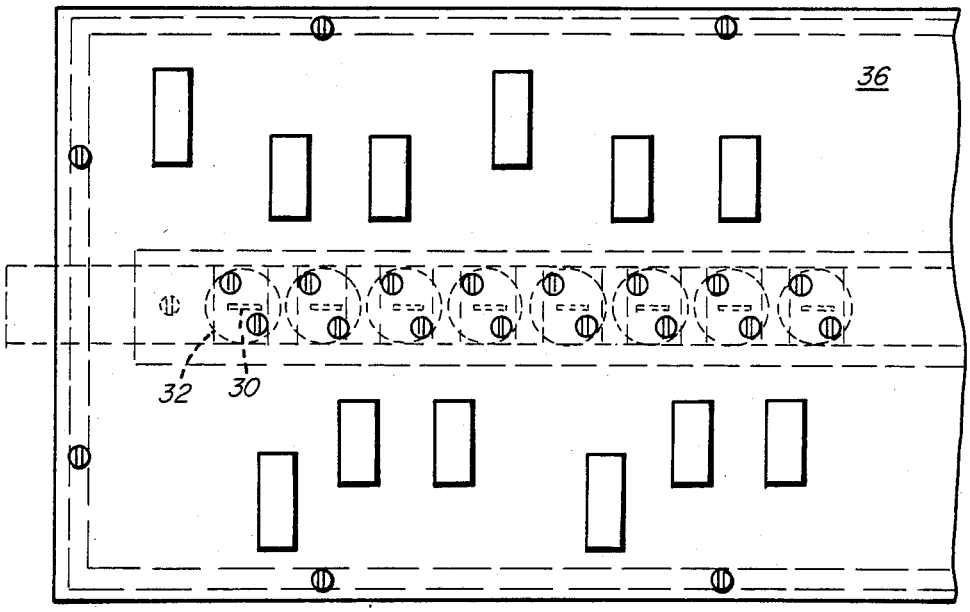
FIG. 4 is a cross-sectional view taken along line 4—4 of FIG. 2.

The sorting machine S (FIG. 1) includes an upper hopper 10 into which the product to be sorted is deposited from a suitable source, such as conveyor system driven by an auger. The product passes from the upper hopper 10 into a lower transverse receiving chute portion 12. The product in the receiving chute 12 is spread out and falls onto a rearwardly slanting corrugated tray 14 which forms the grains of product into a number of parallel channels equal in number to the number of optical viewing channels in a viewing station V (FIGS. 2, 3 and 4). The corrugated tray 14 is moved by a vibratory motor 16 to assist in moving the product to be sorted rearwardly where it descends into a forwardly sloping feed tray 18.

The feed tray 18 is corrugated and has a like number of channels to the upper tray 14 and is mounted with an upper portion 20 of the frame F. In the lower sorter L, the breadth of the channels may be more narrow than in the upper sorter U to more closey singularize the flow of descending product into individual grains, if desired.

The product in each stream to be sorted descends from the corrugated tray 18 into a space 22 (FIG. 2) before a focusing lens 24 of an optical station O (FIG. 3), one of which is provided for each of the channels in the tray 18. The streams of product need not be single individual grains and may, for example, take the form of multiple grains simultaneously present before each focusing lens 24.

Figure 9:
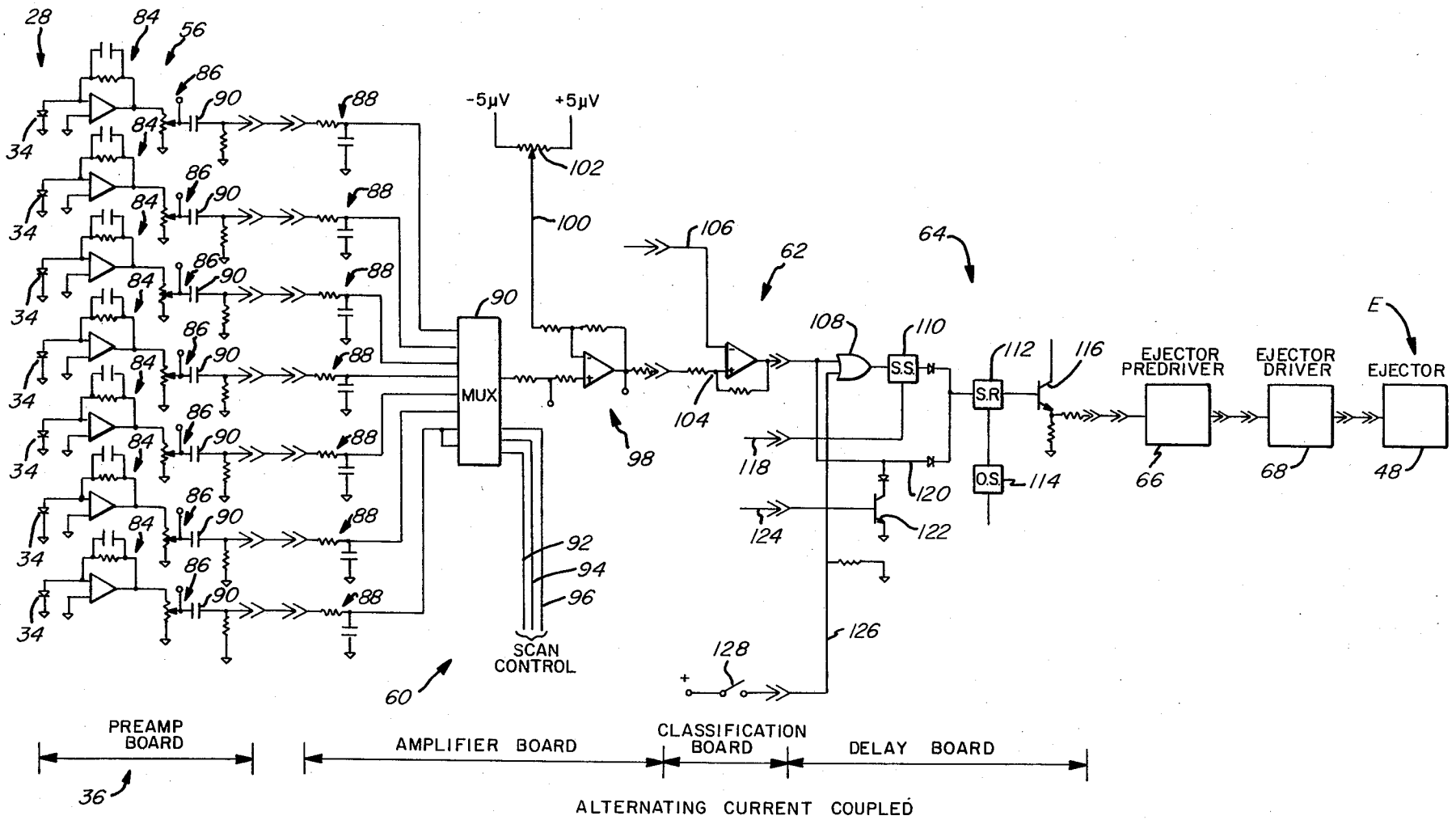
FIG. 9 is a schematic electrical circuit diagram for a single sorting channel in the sorter of FIG. 1.

The focusing lens 24 (FIGS. 2 & 3) in each of the optical viewing stations O is a part of the sorting optics of the apparatus A which focuses light present in the space 22 onto a scanning photocell 28 through a narrow slot 30 formed in a masking disk 32. The scanning photocell 28 for each of the optical viewing stations O is in the form of a plurality of aligned photodiode cells 34 (FIG. 9). The scanning photocells 28 are mounted with a preamplifier board 36 (FIGS. 2 & 4) within a covered electronic chassis 38 (FIG. 1) in each of the upper sorter U and lower sorter L.

Figure 7:
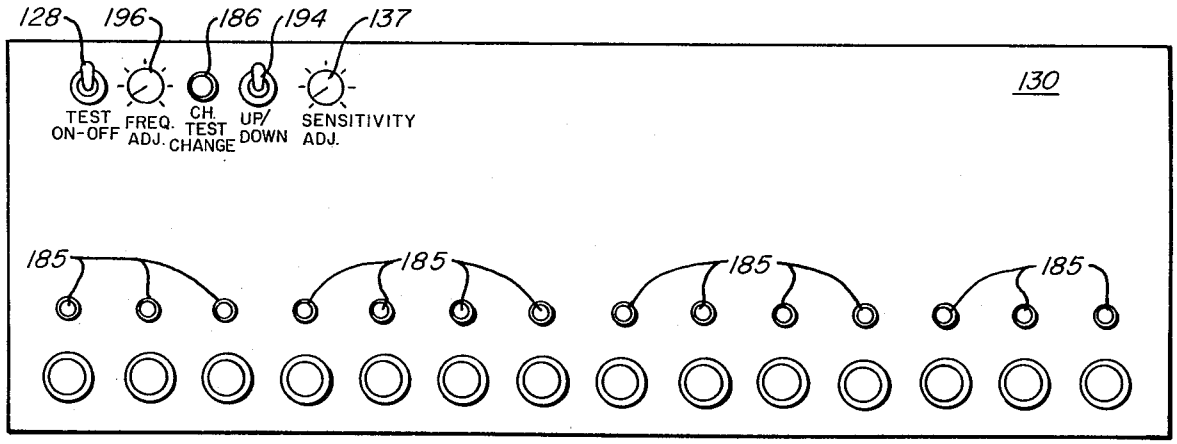
Figure 8:
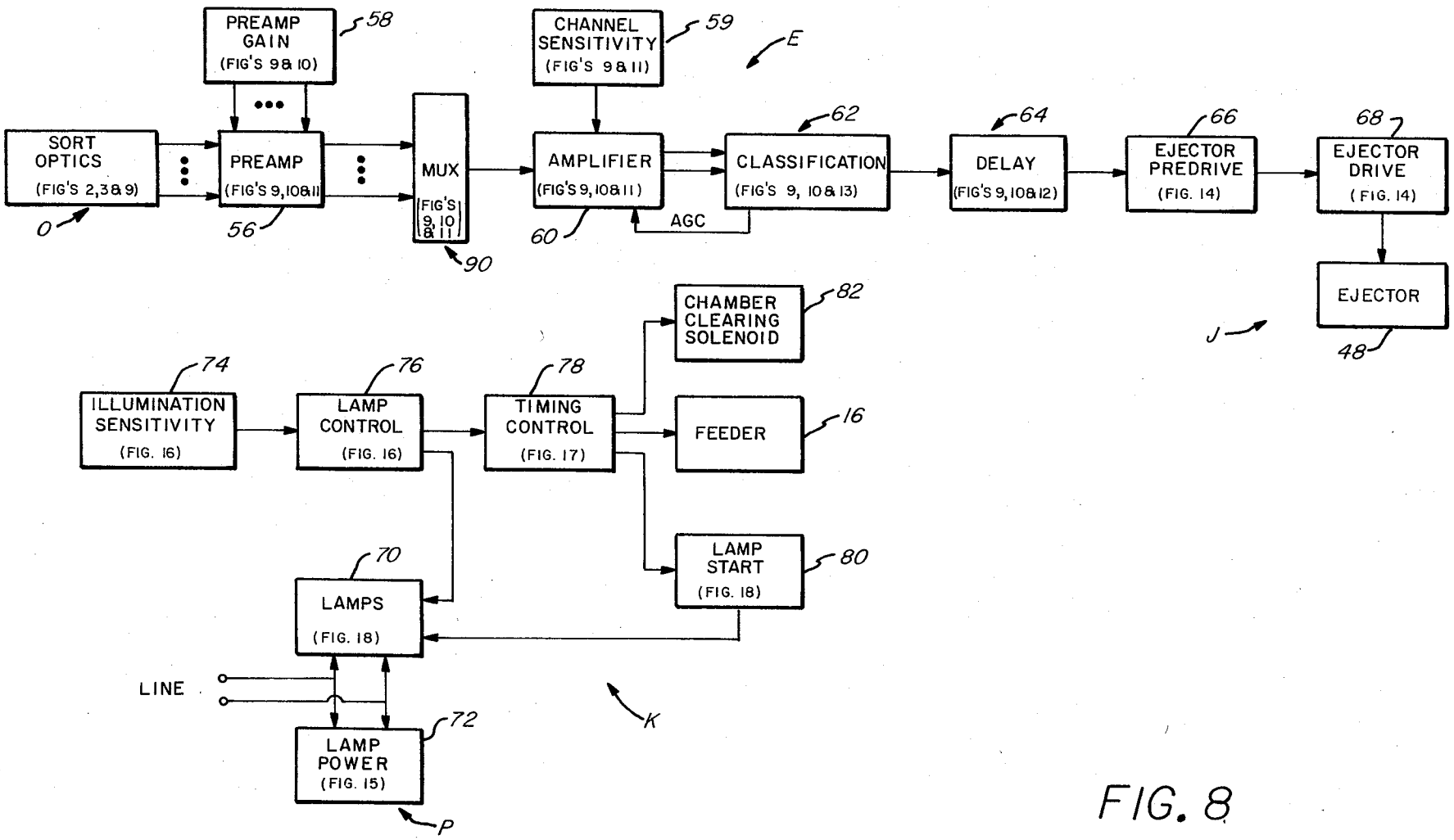
FIG. 8 is a functional block diagram of the sorter of FIG. 1.
Figure 18:
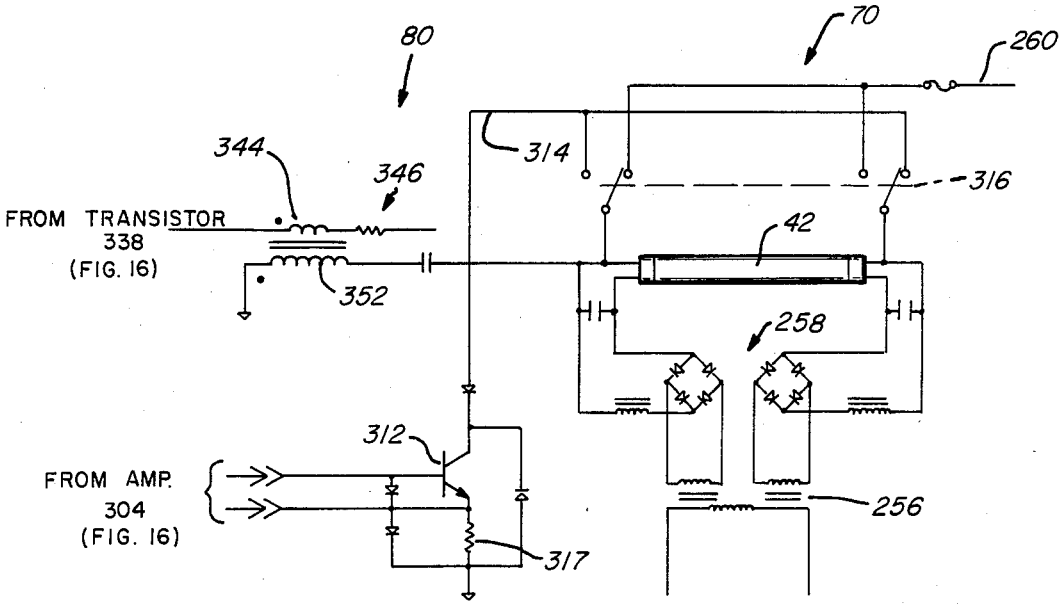

Control panels 40 (FIGS. 1 & 7) are mounted beneath the covered electronic chassis 38 in each of the sorters U and L. The illumination level in the space 22 in the viewing station V is provided by a pair of illuminating fluorescent lamps 42 (FIGS. 2, 8 & 18). A background illumination fluorescent lamp 44 (FIG. 2) provides a reference or background illumination signal onto a reflective plate 46 which provides an indication of illumination conditions onto the lens 24. The background illumination is set at a suitable level to distinguish between unacceptable and acceptable product being sorted. In the event that the product passing through the space 22 is darker than the reference or background level set by lamp 44 for a particular stream of product passing before an optical station O, an ejector solenoid 48 is activated (FIG. 8), producing a jet or blast of air from an ejector J (FIG. 2) which forces the unacceptable product into a discard chute or hopper 50. Acceptable product passes through the viewing station V into a transport chute or member 52 from which it is fed through a funnel 54 (FIG. 1) into a bag or other suitable container.

The discard chute 50 of the upper sorter U transports the rejected product into the feeder chute 14 for the lower sorter L. It should be noted that the unacceptable product stream from the upper sorter U may include otherwise acceptable grains, since the product passes in streams rather than in singularized individual grains into lower sorter L where a similar sorting operation again takes place.

The funnel or feed member 54 may, as is shown in the drawings, be deleted from the lower sorter U and replaced with a conveyor system so that the unacceptable, rejected product from lower sorter L may be discarded or furnished again, along with incoming product to be sorted into the upper hopper 10.

Figure 10:
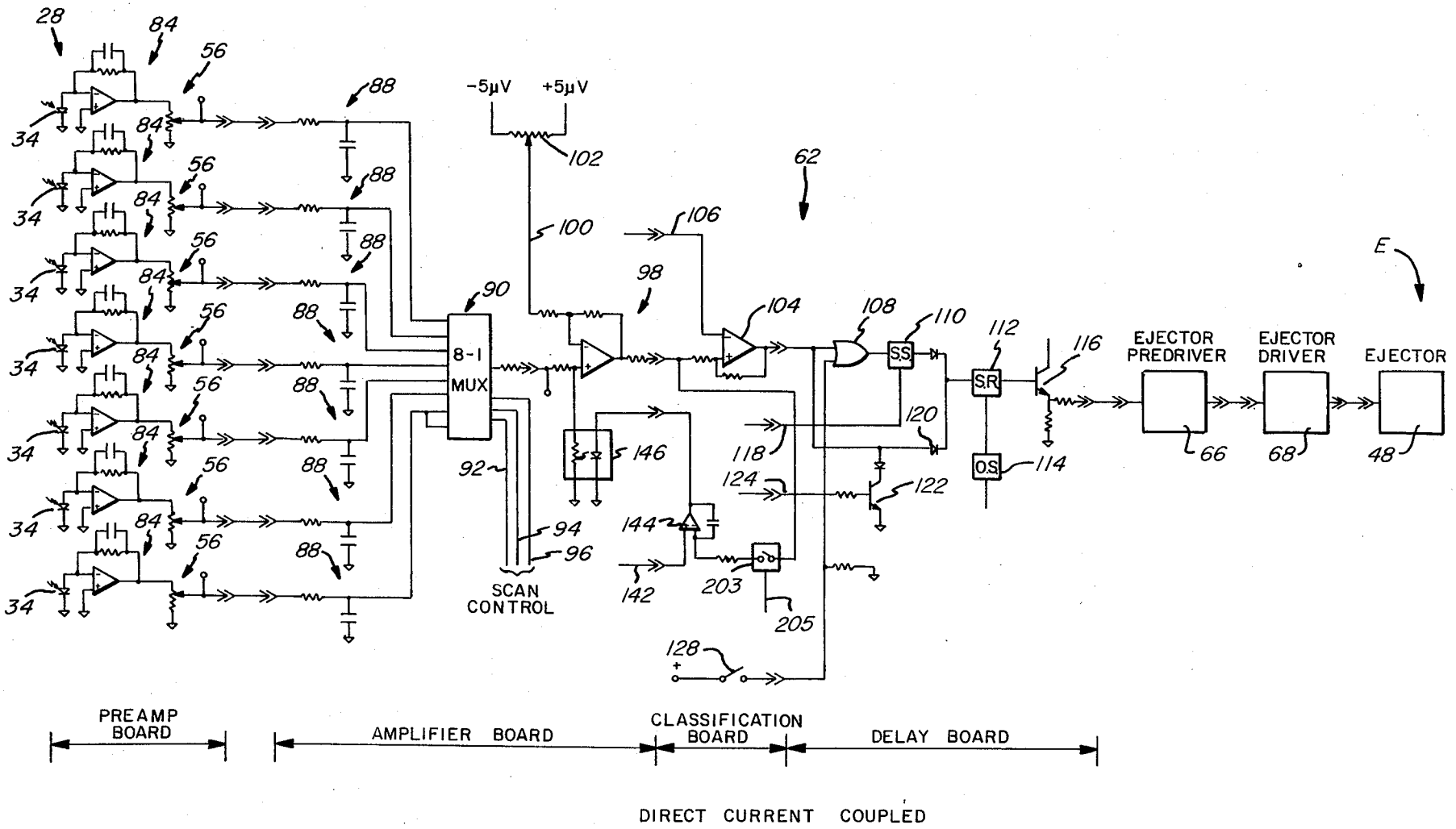
FIG. 10 is a schematic electrical circuit diagram for an alternative single sorting channel for the sorter of FIG. 1.

The sorter S of the present invention includes as electrical circuitry an electronic processing circuit E (FIG. 8) for each channel of product being sorted in the viewing station V, as well as a lamp control circuit K in the power supply P for the sorters U and L. The electronic processing circuit E for each viewing channel includes sorting optics (FIGS. 2 and 3) for each of the optic stations O which sense the light conditions present in the viewing station V adjacent thereto and furnish electrical signals representative of sensed light conditions to a preamplifier circuit 56 (FIG. 8). The sensitivity for each channel of the preamplifier circuit 56 is controlled by a pre-amplifier gain control circuit 58 (FIGS. 9 and 10).

The preamplifier circuit 56 furnishes electrical signals indicative of the optical conditions sensed before the particular associated optical station O in the viewing station V to an amplifier circuit 60 (FIGS. 9, 10 and 11) in the circuit E for that channel. A channel sensitivity circuit 59 is provided for each channel to adjust the sensitivity of that particular channel. The amplified signals from the amplifier circuit 60 are provided to a classification circuit 62 (FIG. 8) where a determination is made as to whether the stream of product passing through the viewing station V in individual channels is acceptable or unacceptable depending upon the degree of darkness of the product.

The classification circuit 62 in one version of circuit E further provides periodic adjustments to the amplifier circuit 60, as will be set forth. In the event that an indication of unacceptable product is formed in the classification circuit 62, a delay circuit 64 allows a suitable interval of time to elapse for the unacceptable product to pass from the optical station O to a position in front of the ejector J, at which an ejector predrive circuit 66 and an ejector drive circuit 68 are caused to energize the ejector solenoid 48, passing a blast of air into the stream of product and diverting the unacceptable stream of product into the chute or funnel 50.

Figure 14:
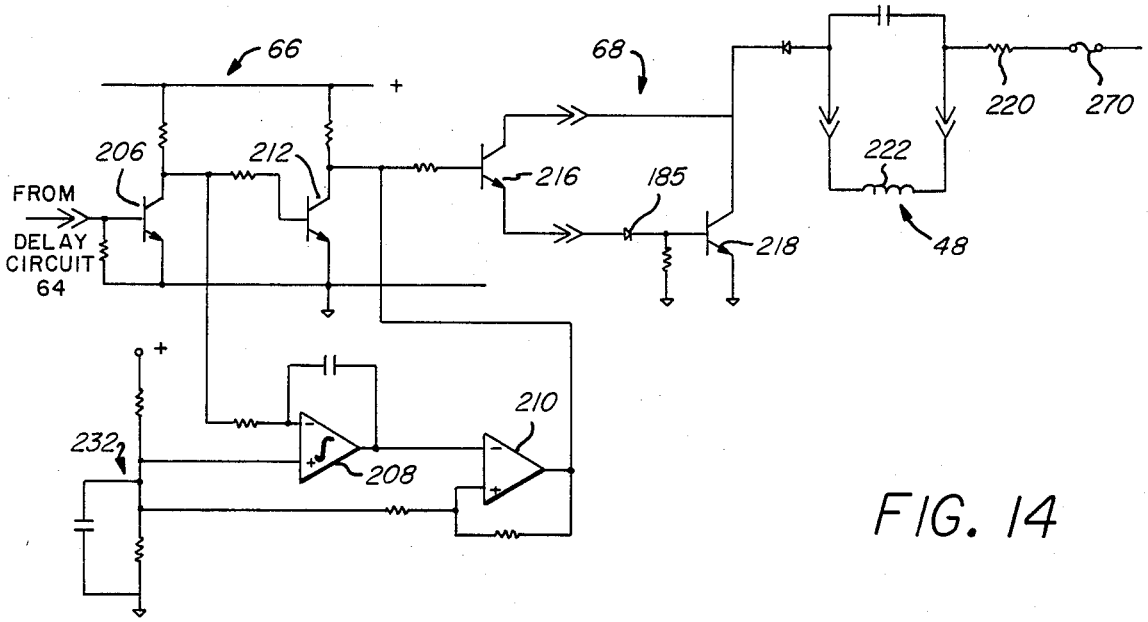

In the lamp control circuit K, the lamps 70 (FIGS. 8 and 18) receive operation power through a power supply circuit 72 (FIGS. 8 and 14). An illumination sensitivity circuit 74 (FIGS. 8 and 16) and a lamp control circuit 76 (FIGS. 8 and 16) adjusts the illumination intensity of the lamps 70. A timing control circuit 78 (FIGS. 8 and 17) periodically reverses the polarity of the direct current driving bias for the lamps 70 through a lamp start circuit 80 (FIGS. 8 and 18). The timing control circuit 78 further periodically activates a chamber clearing solenoid 82 in the viewing station V, to blow dust and accumulated particulate matter from the viewing station V which might otherwise interfere with the accuracy of sorting operations. The timing control circuit 78 further controls the operation of the feeder 16 during the time intervals of operation of the lamp start circuit 80 and chamber clearing solenoid 82.

Turning now to the details of the electronic processing circuit E (FIG. 9), the aligned photocells 34 in a particular one of the optical stations O are provided in a suitable number so that their aligned span equals the width of area focused on them by lens 24. The photocells 34 are electrically connected through an associated preamplifier 84 in preamplifier circuit 56 to a gain reference potentiometer 86 and low pass filter 88. In an alternating current (AC) coupled version of the electronic processing circuit E (FIG. 9), a coupling capacitor 90 is connected between the potentiometer 86 and the low pass filter 88. In a direct current (DC) coupled version of the electronic processing circuit E (FIG. 10), no coupling capacitor is present. Other than the absence of the capacitor 90 and the presence of a periodic automatic gain control function performed by classification circuit 62 on amplifier circuit 60 in the direct current coupled version, both the alternating current and direct current coupled versions of the electronic circuitry E are identical in structure and function to each other.

The low pass filter 88 for each of the aligned optical sensors 34 in a particular optical station O are electrically connected to an analog multiplexer 90 which, under address commands furnished thereto over conductors 92, 94 and 96 from the classification circuit 62 (FIG. 13) selectively and sequentially samples the electrical signals from the pre-amplifiers 84.

Figure 11:
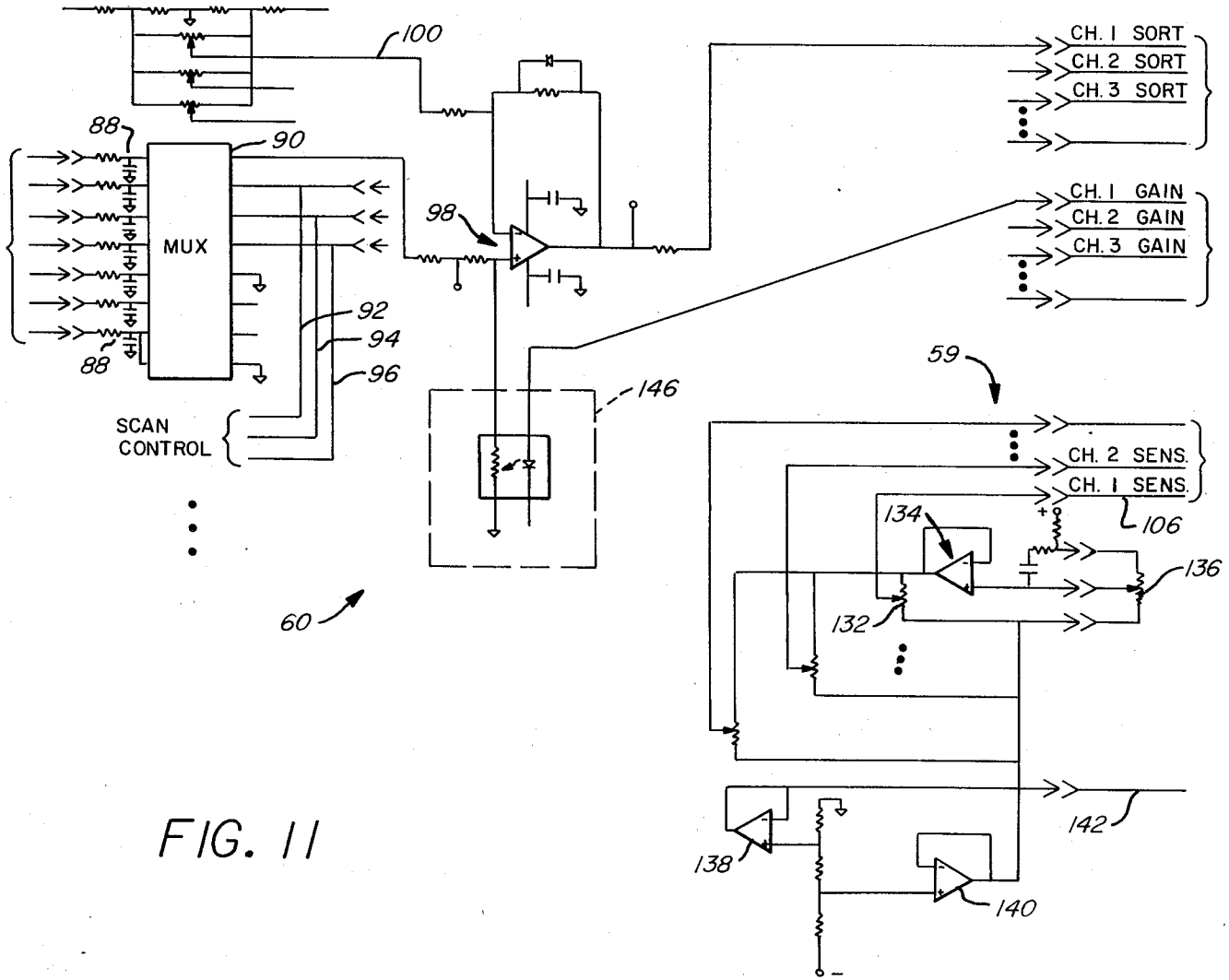
FIGS. 11, 12, 13, 14, 15, 16, 17 and 18 are schematic electrical circuit diagrams of portions of the circuit of FIGS. 9 and 10.
Figure 19:
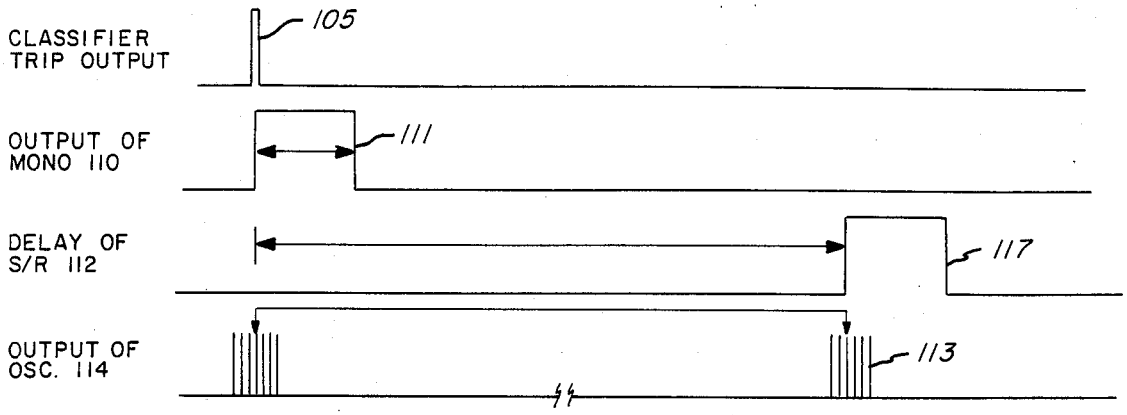
FIGS. 19, 20, 21, 22 and 23 are waveforms illustrative of the operation of the circuitry of FIGS. 9 and 10, although not on a common time scale.

The signals are thus sequentially passed under control of the multiplexer 90 to an amplifier 98 (FIG. 9) which also receives an offset bias signal over a conductor 100 from a potentiometer 102. The signal from the amplifier 98 is provided as one input to a comparator amplifier 104 which receives at its other input a sensitivity level signal over a conductor 106 from the channel sensitivity circuit 50 (FIG. 11). The comparator 104 senses whether or not the darkness of the image presented to the sensing photodiodes 34 exceeds a preestablished sensitivity level for that particular channel. In the event that an unsatisfactorily dark image is present, the comparator 104 provides a classifier trip output signal 105 (FIG. 19) of suitable duration, such as about 25 microseconds, through an OR gate 108 (FIG. 9) to energize a monostable multivibrator or ONE-SHOT 110, forming an ejector pulse 111 (FIG. 19) of from one-half to two milliseconds.

The ejector pulse 111 passes from the multivibrator 110 (FIG. 9) into a shift register 112 which is driven by clock pulses 113 (FIG. 19) from an oscillator circuit 114 (FIG. 9). The frequency of clock pulses 113 from the oscillator circuit 114 controls the speed and movement of the ejector pulse 111 from the multivibrator 110 through the shift register 112 so that the unsatisfactory or abnormal dark grain of product being sorted is present before the ejector jet J at the time the ejector solenoid 48 is energized. The ejector pulse 111 formed in the multivibrator 110 after a time passage through the shift register 112 of from four to eight milliseconds energizes a transistor 116 with a pulse 117 (FIG. 19), passing a signal through the ejector predriver circuit 66 and ejector driver circuit 68 to activate the ejector solenoid 48.

Figure 13:
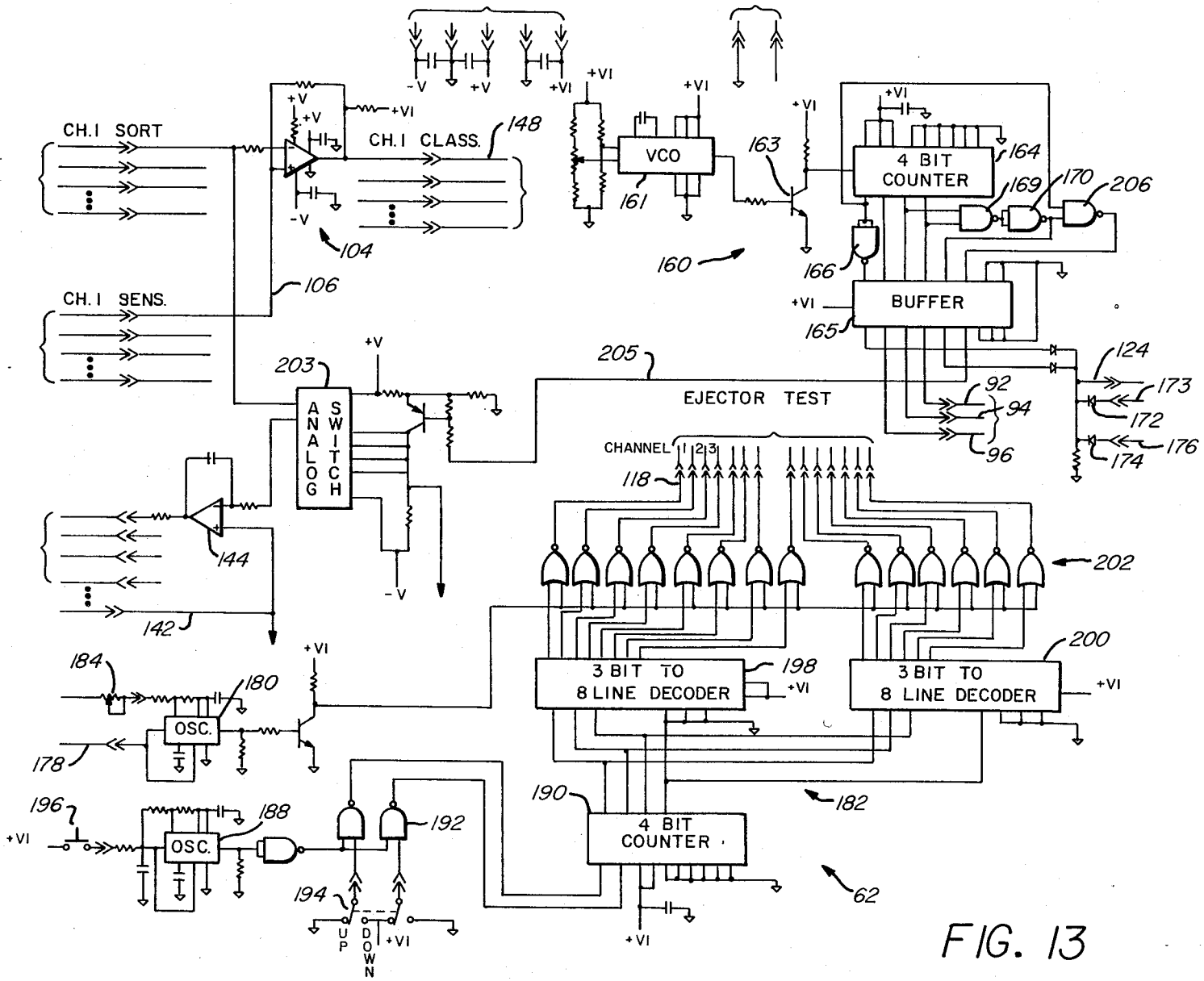

The multivibrator 110 for each sorting channel may also be periodically activated by an ejector test signal for that particular channel over a conductor 118 from gating circuitry in the classification circuit 62 (Fig. 13). A bypass conductor 120 (FIG. 9) is connected at the output of the comparator amplifier 104 to permit a signal to be provided directly to the shift register 112 from the comparator 104 so that an unduly long time interval of a detected unacceptable condition, usually longer than the duration of ejector pulse 111 does not pass undetected. This permits long duration dark spots to be detected and not be overlooked during the reset time of the multivibrator 110.

An inhibit transistor 122 (FIGS. 9 and 10) is connected to the conductor 120 to ground or inhibit passage of signals from the comparator amplifier 104 during switching of the multiplexer 90 to the next successive optical sensor during the first half of each time slot for the channel. The transistor 122 is energized over a conductor 124 from the classification circuit 62 (FIG. 13). The gate 108 is also electrically connected by a conductor 126 to an ejector test on-off switch 128 (FIGS. 7 and 9) which is located on a control panel 130 (FIGS. 1 and 7).

The sensitivity control signals for each of the viewing channels 0 are formed in its channel sensitivity circuit 59 (FIG. 11), as exemplified by the one on the conductors 106, are established by means of a potentiometer 132 for that channel and connected through an amplifier 134 to an overall or common sensitivity control potentiometer 136. The adjustment of the potentiometer 136 is controlled by a knob 137 (FIG. 7) on the panel 130. The individual channel sensitivity signals are furnished over conductors, such as a conductor 106 to the comparator amplifier 104 for that particular channel (FIG. 13).

For the direct current coupled version of electronic processing circuit E (FIG. 10), amplifier 138 (FIG. 11) establishes a gain reference signal over a conductor 142 which is provided to an integrating comparator amplifier 144 (FIG. 10) in a gain control feedback network 146. The output of the amplifier 144 (FIG. 10) is provided to a light emitting diode of gain control network 146 (FIGS. 10 and 11) to control the resistance of a photosensitive resistor in network 146. This resistance, as controlled, is connected to an input to amplifier 98 to periodically adjust the gain of amplifier 98.

Figure 12:
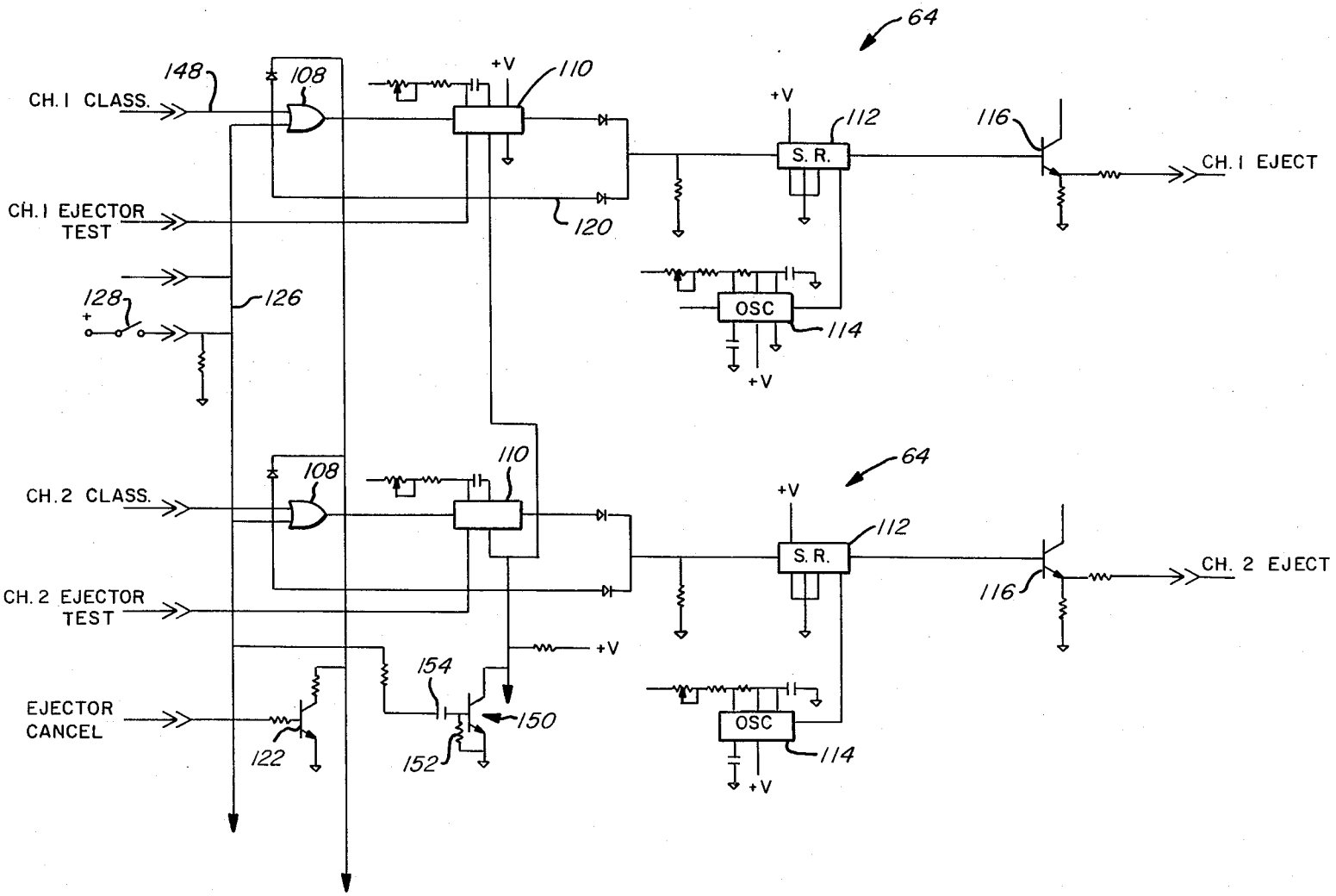
Figure 22:
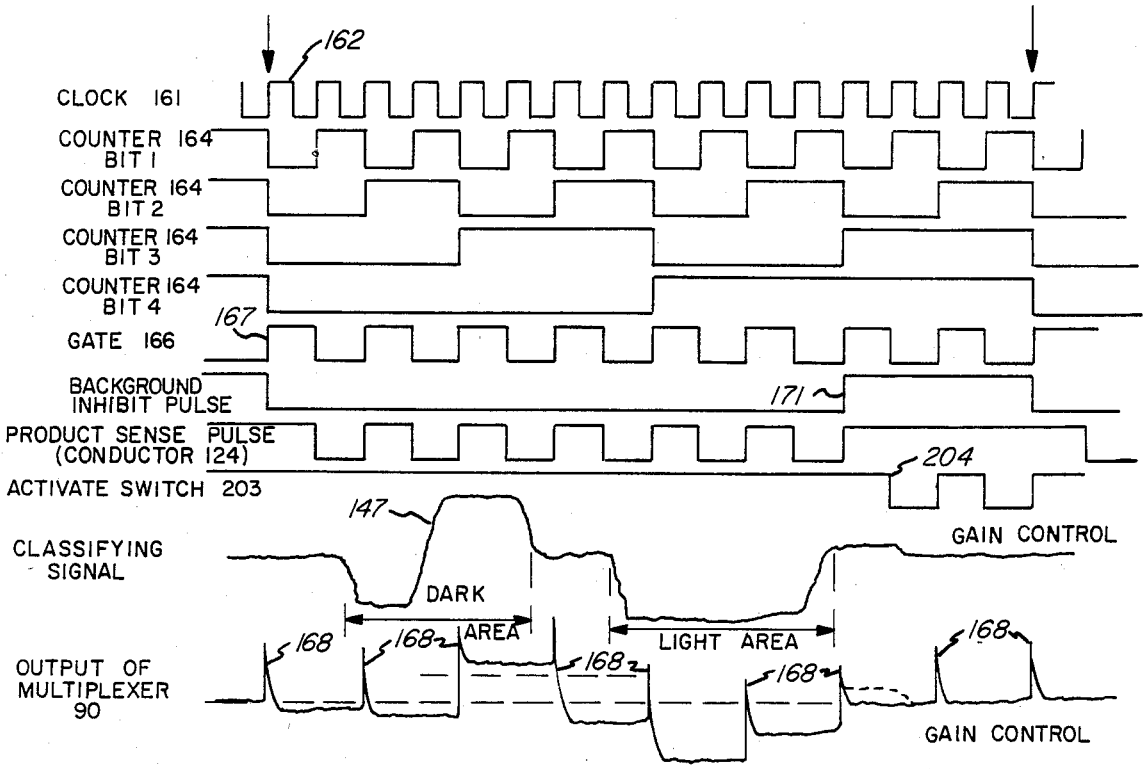

A classifying signal 147 (FIG. 22) is formed for each channel of the viewing stations V in its comparator amplifier 104 and is furnished over a conductor 148 to the gate 108 (FIGS. 9 & 12). In the event of an unacceptable product or products in the chamber in front of the viewing station V, ejector pulse 111 is formed to drive the ejector solenoid 48 in the manner set forth above. In the delay circuit 64 (FIG. 12), a transistor 150 is electrically connected in common to the inhibit input of the multivibrators 110 for each channel. The transistor 150 and a resistor 152 and capacitor 154 associated therewith establish a brief time delay upon initiating the ejector test function during which the multivibrators 110 are inhibited, preventing ejector pulses 111 from being formed during this transient situation.

The classification circuit 62 (FIG. 13) includes a time slot control circuit 160 which furnishes the scan control signals over conductors 92, 94 and 96 to the multiplexer 90 (FIGS. 9–11) to sequentially scan the aligned optical sensors in a particular viewing channel or optical station O. In the time slot control circuit 160, (FIG. 13) a master voltage controlled oscillator 161 providing master frequency signals 162 (FIG. 22) at a frequency of about eighty kilohertz is coupled through a logic level converting transistor 163 to a four bit binary counter 164. The transistor 163 provides compatibility between logic levels of oscillator 161 and counter 164 when the latter components have different logic levels. The binary counter 164 provides four bit counting signals indicated in FIG. 22 to drive a decoding buffer circuit 165 to cause multiplexer 90 to individually select the aligned optical sensors 34 via conductors 92, 94 and 96 in a sequence. The scanning rate of the multiplexer 90 is about twenty kilohertz.

An inverter gate 166 reverses the logic level of the bit one count from counter 165 to inhibit by means of an inhibit pulse waveform 167 over conductor 124, sensing of optical conditions during the first half-cycle for each of the photodiodes 34. This disables the gate 108 and multivibrator 110 during the first half-cycle of each scanning cycle. In this manner, spikes or transients 168

(FIG. 22) formed during each switching operation of the multiplexer 90 are inhibited from being detected as undesirable dark spots in the product being sorted.

In the direct current-coupled embodiment of the present invention, one of the photodiodes 34, typically the last in the row, is located in each viewing station O at a position away from the descending stream of product to sense background illumination levels for gain control purposes. A gate 169 is connected to appropriate bits, such as the third and fourth ones, from counter 164 to form, after inversion in gate 170, an inhibit pulse 171 for the duration of a background sensing interval once during each photodiode scanning cycle. It is during this background sensing interval that background illumination conditions in the viewing station V before the particular photocell 28 are monitored. This inhibit pulse from gate 170 passes through buffer 165 during the background sense interval over conductor 124 (FIGS. 9, 10, 12 and 13) to the delay circuit 64 to inhibit classification or sorting during background sensing. This inhibit function occurs in a like manner to the lamp reversal inhibit function when polarity of the illuminating lamps 42 is being reversed, as will be set forth.

Another classify inhibit function is performed by diode 174 over a conductor 176 when the ejector test switch 128 (FIGS. 7 and 12) has been activated. Activation of the ejector test switch 128 further provides operating power over a conductor 178 (FIG. 13) to a frequency control oscillator 180 in an ejector channel selector circuit 182 in the classification circuit 62. The oscillator 180 establishes the rate at which the ejectors E in each of the individual channels are pulsed. The frequency of the oscillator 180 is controlled by a potentiometer 184 which is adjusted by an ejector frequency control knob 196 (FIG. 7) on the panel 130. When the ejector for a particular channel is being selected and tested by the counting circuit 182, an indicator light emitting diode 185 (FIG. 7) on the panel 130 is also energized, indicating that such testing is being performed. The indicator light emitting diodes 185 also indicate ejector operation during normal sorting operations.

The channel test counter circuit 182 (FIG. 13) is driven by an oscillator 188 which drives a four bit digital counter circuit 190 through a set of UP/DOWN control gates 192. The gates 192 are activated by an UP/DOWN control switch 194 (FIG. 7) on the front panel 130 and control whether the count of pulses stored in the counter 190 (FIG. 13) is to be increased or decreased on each pulse from the oscillator 188. The oscillator 188 is activated under control of a change test channel button 196 on the panel 130. The count stored in the counter 190 of the test channel counter circuit 182 is provided to decode circuits 198 and 200 which in connection with a set of parallel NOR gates 202 decode and indicate the particular ejector solenoid 48 to be tested.

For the direct current coupled version (FIG. 10) of the sorter S, an analog switch 203 (FIGS. 10 and 13) is provided to receive a gain adjust activate signal 204 (FIG. 22) over a conductor 205 (FIGS. 10 and 13). The analog switch 203 is activated by signal 204 during the last two scanning cycles of the counting circuit 160 as detected by a gate 206 at the output of gate 170 and furnished through buffer 165. In this manner, viewing conditions sensed by that particular channel are passed through the electronic processing circuit E to the reference amplifier 144 and photosensitive resistor 146 to adjust the input attentuator of amplifier 98 to compensate for background conditions in the optical station O. During this time, a signal is furnished over conductor 124 (FIGS. 9, 10, 12 and 13) to inhibit ejector operations.

Figure 20:
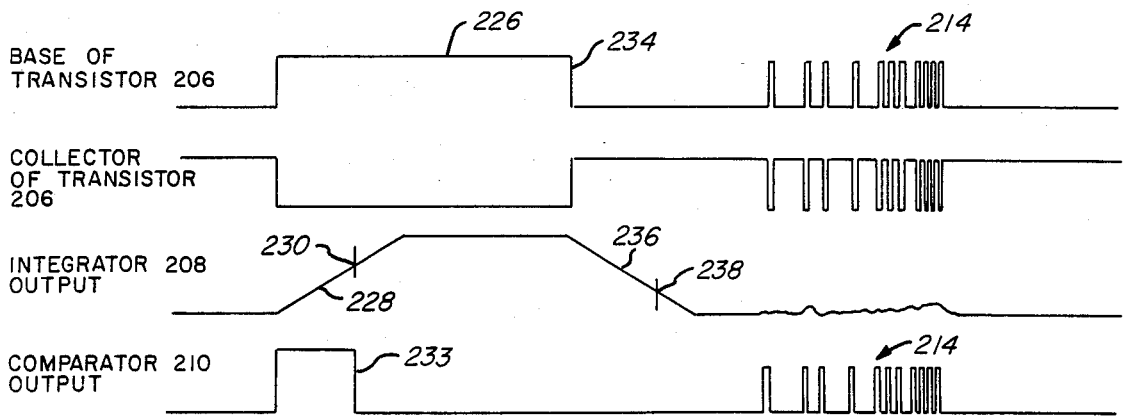

In the ejector predrive circuit 66 (FIG. 14), an input signal from the delay circuit 64 is received, causing a transistor 206 to conduct. An integrating amplifier 208 connected to the collector of the transistor 206 begins accumulating a charge at this time, building up a voltage which is furnished to a comparator amplifier 210. The output of the comparator 210 is connected to the collector of a transistor 212. During normal sorting operations, pulses from the delay circuit 64 are passed through the transistors 206 and 212, as indicated at 214 (FIG. 20), giving rise to short duration pulses which energize power transistors 216 and 218, permitting operating voltage to pass through a current limiting resistor 220 to a coil 222 of ejector solenoid 48 driving the ejector J. When this occurs, the indicator light-emitting diode 185 on the panel 130 (FIG. 7) for that channel is energized, indicating that its ejector 48 is receiving current.

There are at times instances when a relatively long trip signal, on the order of several seconds, as indicated at 226 (FIG. 20) renders the transistor 206 conductive. At the beginning of the time interval 226, the output of integrator 208 (FIG. 14) begins to increase, as indicated by a waveform 228. At a point in time, indicated at 230, the output of the integrator 208 exceeds the bias level provided to the comparator 210 by a bias establishing network 232, causing the comparator 210 to reverse states, or clamp, as indicated at 233. For the remainder of the long duration trip signal waveform 226, the output of comparator 210 remains at a level inhibiting the flow of current through the power transistors 216 and 218, inhibiting the flow of excess current through the solenoid 222 of the ejector 48, preventing damage to the solenoid 222. At a point 234 of termination of the trip signal 226, the voltage at the output of integrator 208 begins to decrease, as indicated at 236, until a point 238 is reached where input to the comparator 210 is unclamped.

Figure 5:
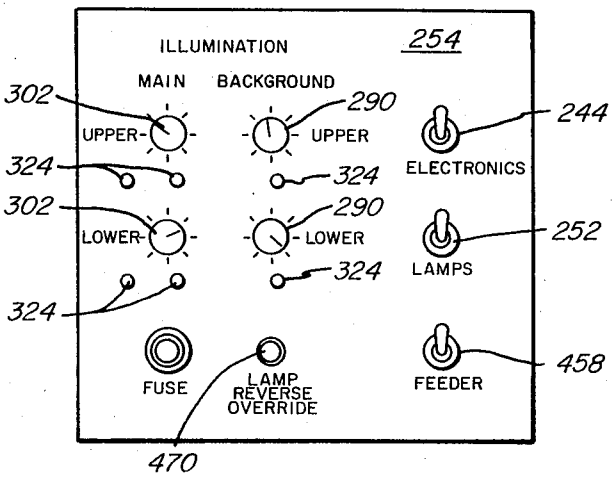

In the lamp power control circuit 72 (FIG. 15), operating power is provided over input lines 240 and 242 to an electronics control on-off switch 244. When the switch 244 is closed, alternating current on the lines 240 and 242 is passed through a transformer 246 to suitable direct current power supply circuit 248. A cooling fan 250 and lamp filament transformers 256 (FIG. 18) at this time also receive operating power from the lines 240 and 242. A lamp ON/OFF switch 252 mounted on a control panel 254 (FIG. 5) controls the application of electrical power from the lines 240 and 242 to a lamp power supply transformer 257 (FIG. 15) which through a controlled rectifier network 258 provides direct current voltage over a line 260 (FIGS. 15 and 18) to the lamp circuit 70, providing operating power for the lamps 42.

A solid state relay 262 (FIG. 15) of circuit 72 is electrically connected to the lines 240 and 242. On closure of the lamp switch 252, relay 262 permits current to flow through an ejector ON/OFF switch 264 mounted on the control panel 254 (FIG. 5) so that the alternating current voltage on the lines 240 and 242 (FIG. 15) may pass to a transformer 266 and a rectifier circuit 268, providing an operating power bias over a conductor 270 to the ejector drive circuit 68 (FIG. 14). A transformer 272 also receives alternating current voltage when the switch 264 is closed, and through a rectifier network 274 provides direct current operating power to the feeder power control 275 which under control of timing control circuit 78 applies power to the feeders 16 for both the upper sorter U and lower sorter L. Electrical power is also provided to drive solenoids 276 and 278 as commanded by timing control 78. The solenoids 276 and 278 if used in a manner to be set forth below, periodically provide a purging blast of air through the viewing stations V of the sorters U and L in order to clear any dust and extraneous matter which may have accumulated in the viewing stations during operation of the sorter S.

In the illumination sensitivity circuit 74 (FIG. 16), a background illumination sensing photodiode 280 is located in the vicinity of the background illumination lamp 44 (FIG. 2) and provides a signal indicative of the sensed optical conditions through a converting amplifier 282 (FIG. 16) to a first input of a differential amplifier 284. The differential amplifier 284 receives at its other input a background illumination sensitivity level set by a potentiometer 286 which is furnished thereto through a buffer amplifier 288. The setting of the potentiometer 286 is controlled by a control knob 290 (FIG. 5) on the control panel 254.

The illumination sensitivity circuit 74 (FIG. 16) further includes sensing photodiodes 292 located near each of the main illumination lamps 42 for both of the sorter stations in the sorter S. The photodiodes 292 form electrical signals indicative of the illumination conditions sensed. These signals are furnished through buffer amplifier 294 and are provided to differential amplifiers 296. The differential amplifiers 296 further receive at their other inputs a reference level signal furnished through buffer amplifiers 298 by a sensitivity setting potentiometer 300. The setting of the potentiometer 300 is controlled by a sensitivity adjustment knob 302 (FIG. 5) on the control panel 254.

The differential amplifiers 284 and 296 form signals whose voltage is indicative of the difference between the desired illumination level in the viewing stations, as indicated by the potentiometers 286 and 300, and the actual illumination conditions, as sensed by the photodiodes 280 and 292. The differential signals formed in the amplifiers 284 and 296 are furnished to operational amplifiers 304 which function as voltage to current converters. The output current from the operational amplifiers 304 thus represents the differential between desired and actual illumination intensity conditions in the viewing station V. This differential controls the amount of current which flows through power transistors 312 (FIG. 18) connected to the output of operational amplifiers 304. Each of the power transistors 312 is connected by a conductor 314 through a polarity reversal switch 316 to one of the lamps 42 in the lamp control circuit 70 (FIG. 18). The transistors 312 permit current to pass through the lamps 42 at a controlled level thereby controlling the intensity of the illumination provided by the lamp 42.

The conductor 310 provides the negative input to amplifier 304 (FIG. 16) with a voltage established by the current through a resistor 317 (FIG. 18) at the emitter of power transistor 312 which indicates the amount of current through the associated lamp 42. The voltage on conductor 310 thus represents the current through the associated lamp and is connected through a coupling resistor 318 of lamp control circuit to a first input of a comparator amplifier 320 to provide an indication of the magnitude of the current flowing through the lamp 42. The other input of the comparator amplifier 320 is provided with a reference level formed by a resistor network 322 indicative of the maximum rated current for the lamp 42. As long as the current level flowing through the conductor 310 to lamp 42 does not exceed the rated current for the lamp 42 as indicated by the resistor network 322, the comparator amplifier energizes an indicator light emitting diode 324*a* of an encapsulated indicator pair 324 on control panel 254 indicating that rated current for the lamp has not been exceeded. In the event that the comparator 320 senses that rated current through lamp 42 has been exceeded, comparator 320 changes state and energizes as an alternative indicator light emitting diode 324*b* of pair 324. Light emitting diode 324*a* is preferably one that emits green light while a light emitting diode 324*b* is preferably one that emits red. It should be understood, however, that different colors of light may be equally as well used.

Figure 21:
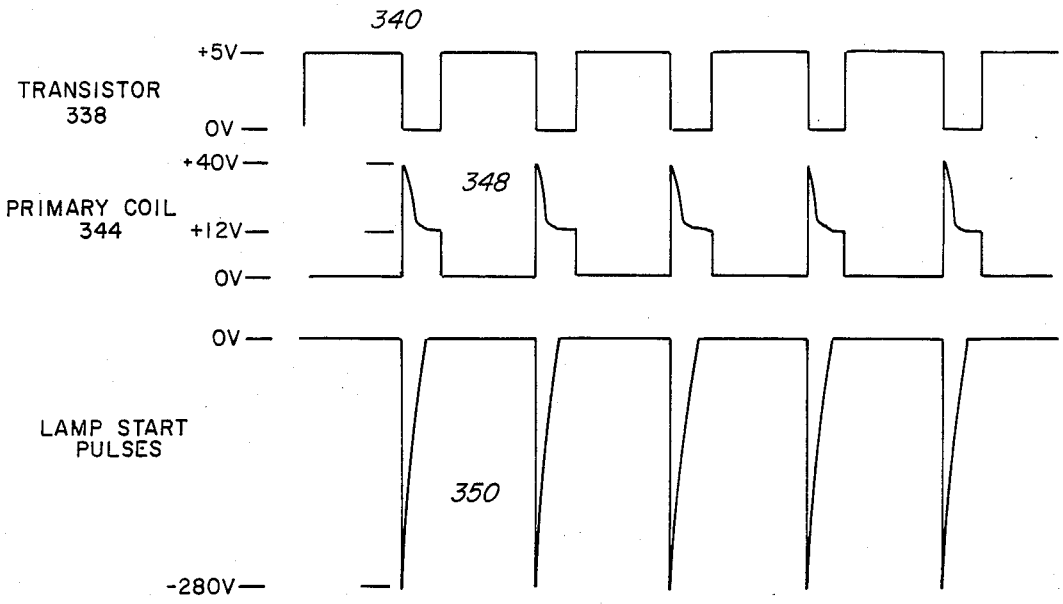

The conductor 310 is also connected through a resistor 328 to a comparator operational amplifier 330. The amplifiers 330 also function as current sensors and hold a common output conductor or bus 332 at a low level until all of the lamps 42 are sensed to be conducting at least some minimum current. The conductor 332 is connected to a transistor 334 which is not conductive so long as the conductor 332 is at a low level, indicating that not all of the lamps 42 are conducting current. With the transistor 334 non-conductive, an oscillator 336 provides pulsed current signals to a transistor 338 as indicated by a waveform 340 (FIG. 21) which are provided in common to the primary side 344 (FIG. 18) of a transformer 346 in the lamp start circuit 80. The primary side 344 of the transformer 346 forms a voltage waveform 348 (FIG. 22) with a positive-transient or spike due to its inductive reactance. The wave form 348 in the primary side 344 of transformer 346 induces a large negative going pulse 350 (FIG. 21) in a secondary coil 352 of the transformer 346, which is furnished to the lamp 42 until the lamp 42 becomes conductive.

Once all of the comparator operational amplifiers 330 (FIG. 16) sense that the lamp associated therewith is conducting current, the voltage on conductor 332 transits to a high level, rendering transistor 334 conductive and inhibiting oscillator 336 from forming further pulses.

One blade of the lamp ON/OFF switch 252 (FIGS. 5, 15 and 16) is also electrically connected to the inhibit input terminal of the oscillator 336 (FIG. 16) so that when the switch 252 is moved to the OFF position (FIG. 16), oscillator 336 is inhibited from forming lamp start pulses. When this blade of the switch 252 is moved to the ON position, the solid state relay 262 (FIG. 15) is energized over the conductor 352.

Figure 15:
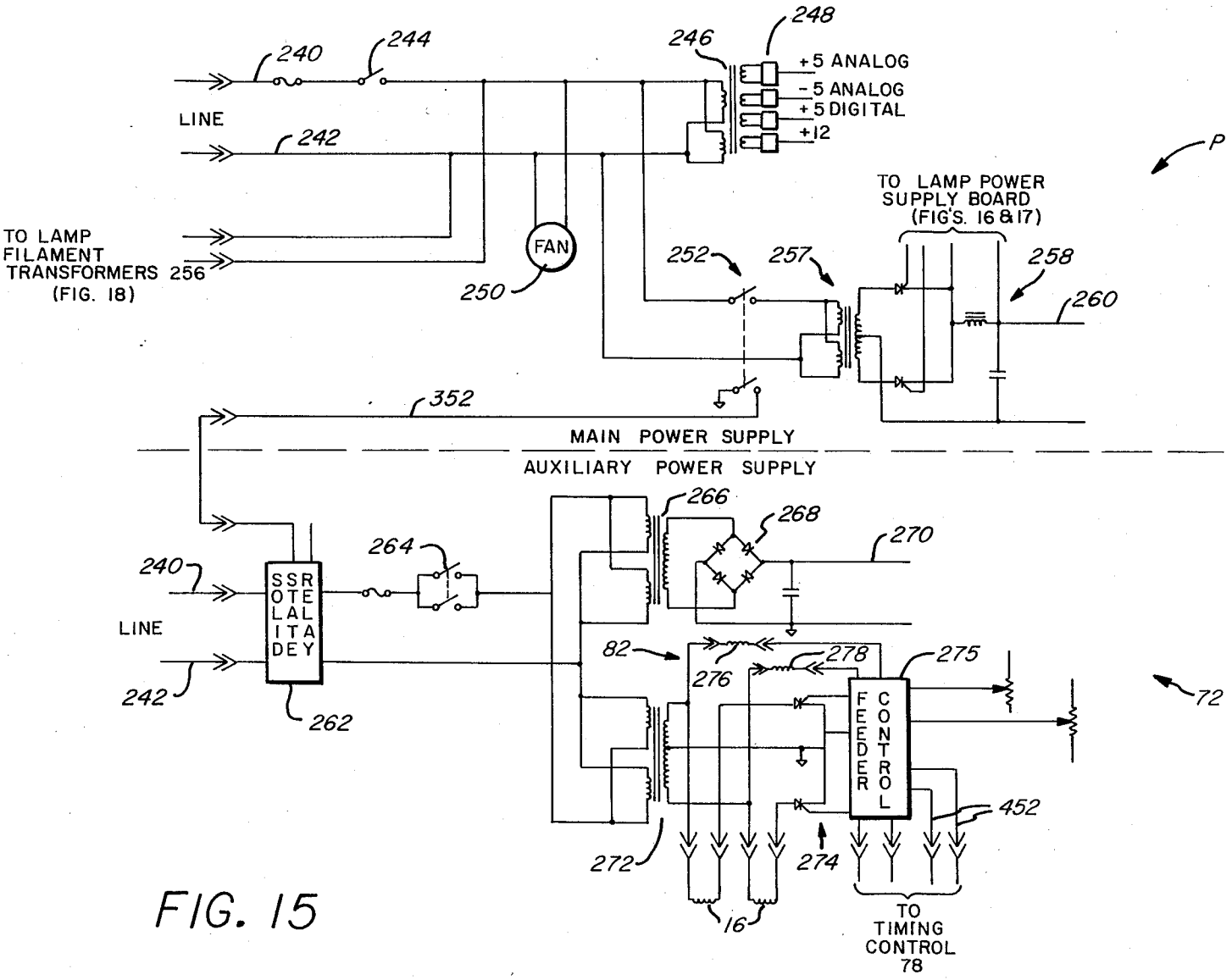
Figure 16:
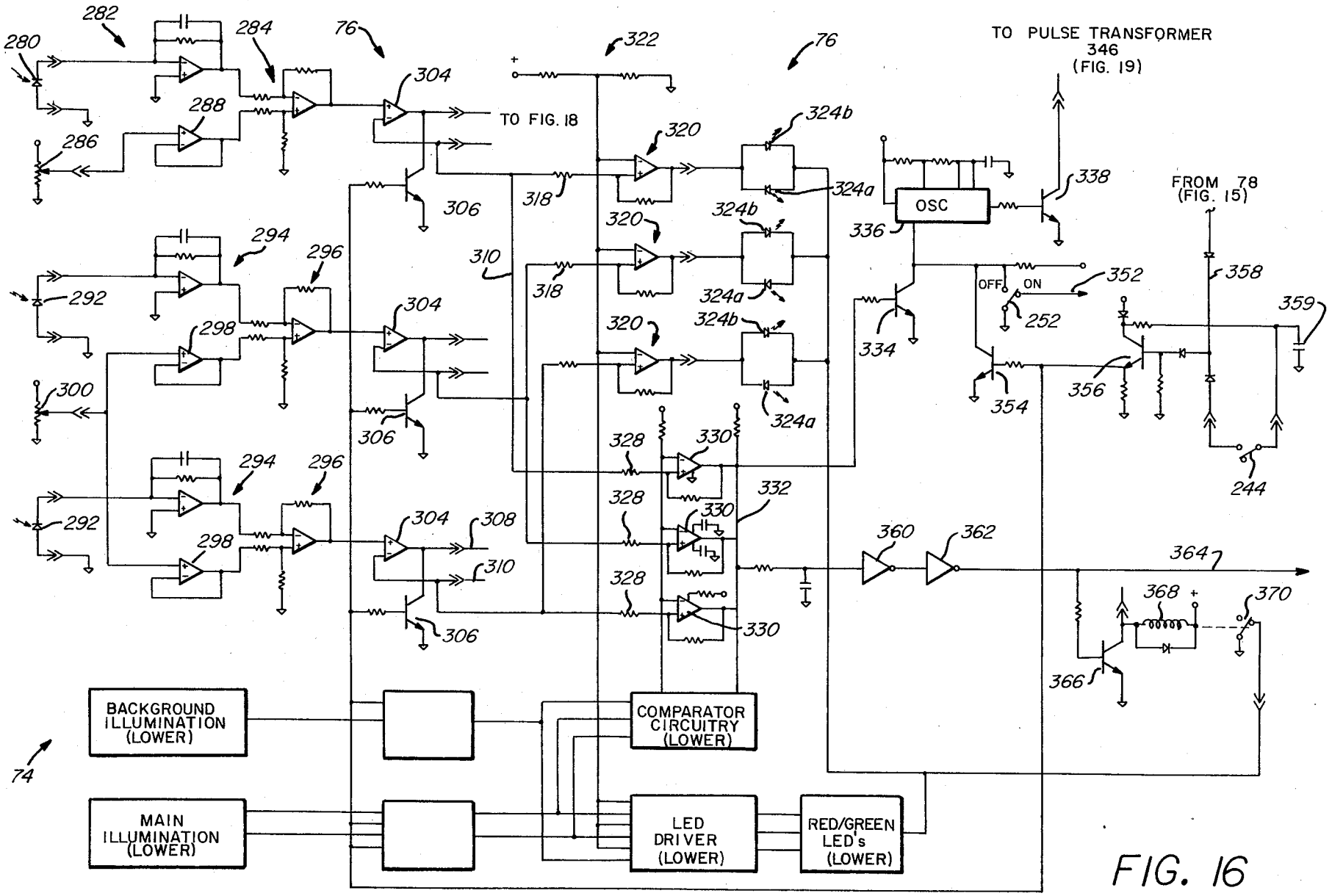
Figure 17:
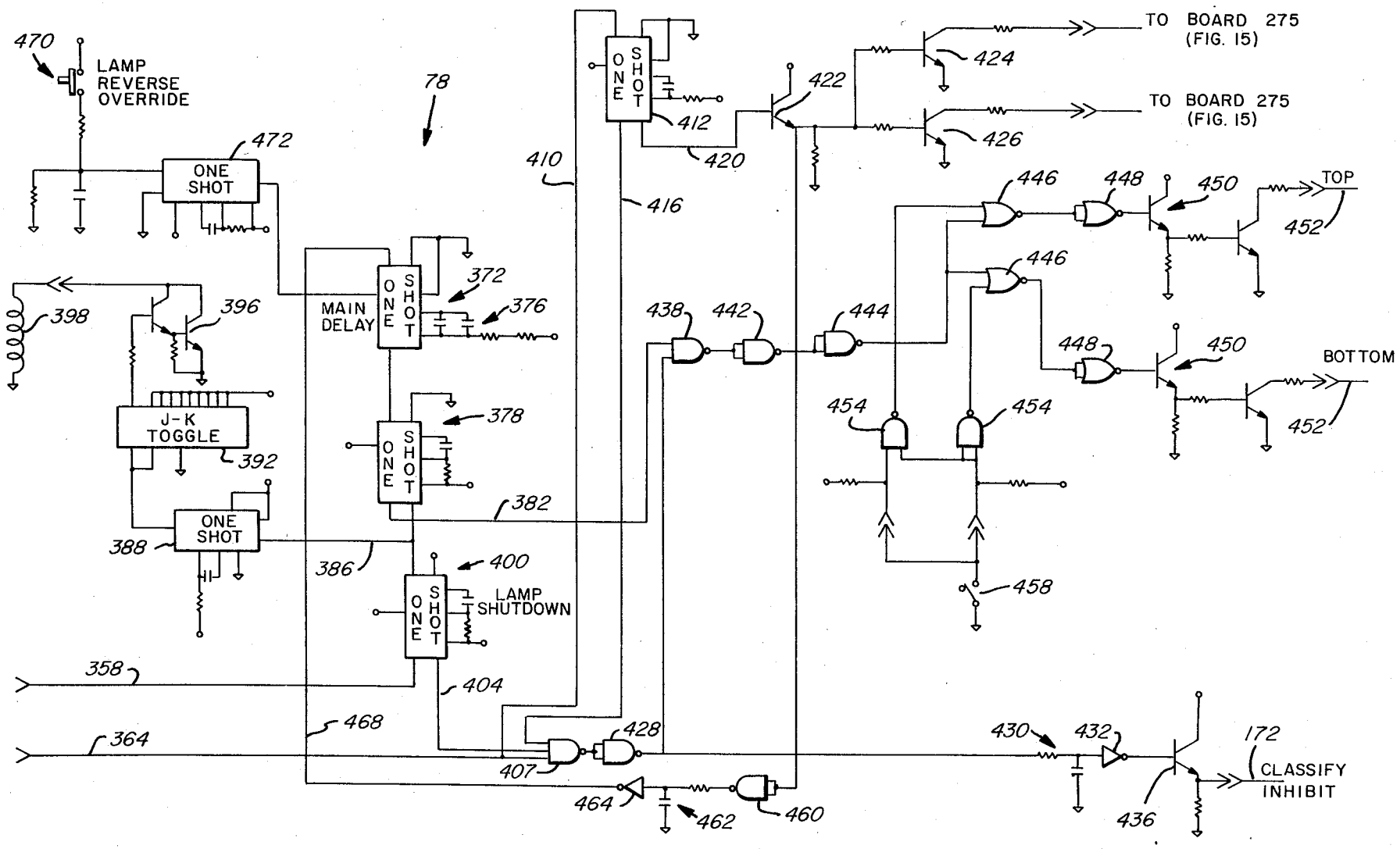

The inhibit input terminal of the oscillator 336 is also electrically connected to an oscillator inhibit transistor 354 (FIG. 16) whose operation is controlled by a lamp current inhibit transistor 356. The lamp current inhibit transistor 356 is electrically connected to the base of each of the transistors 306. When the transistor 356 is energized, the collectors of the transistors 306 are grounded, inhibiting the flow of current through the power transistors 312 and lamps 42. The transistor 356 turns on the transistor 306 and inhibits oscillator 336 through transistor 354 on receipt of a lamp shutdown signal over a conductor 358 from the timing circuit 78 or by opening of the switch 244 (FIGS. 15 and 16). A damping capacitor 359 slowly discharges current through closed switch 244 to prevent rapid change of polarity of the lamps 42.

The electrical conductor 332 is connected through two inverter stages 360 and 362 by a conductor 364 to the lamp timing circuit 78 (FIG. 17) to indicate to the timing circuit 78, by the voltage level present on conductor 364, whether or not all of the lamps 42 as sensed by capacitor amplifiers 330, are conducting current. A transistor 366 is rendered conductive when voltage conditions on conductor 364 indicate that all lamps are receiving current, permitting current to pass through a relay coil 368, moving a contact 370 to a position to provide an electrical ground for indicator light-emitting diodes 324 and 326 so that they can emit light.

Figure 23:
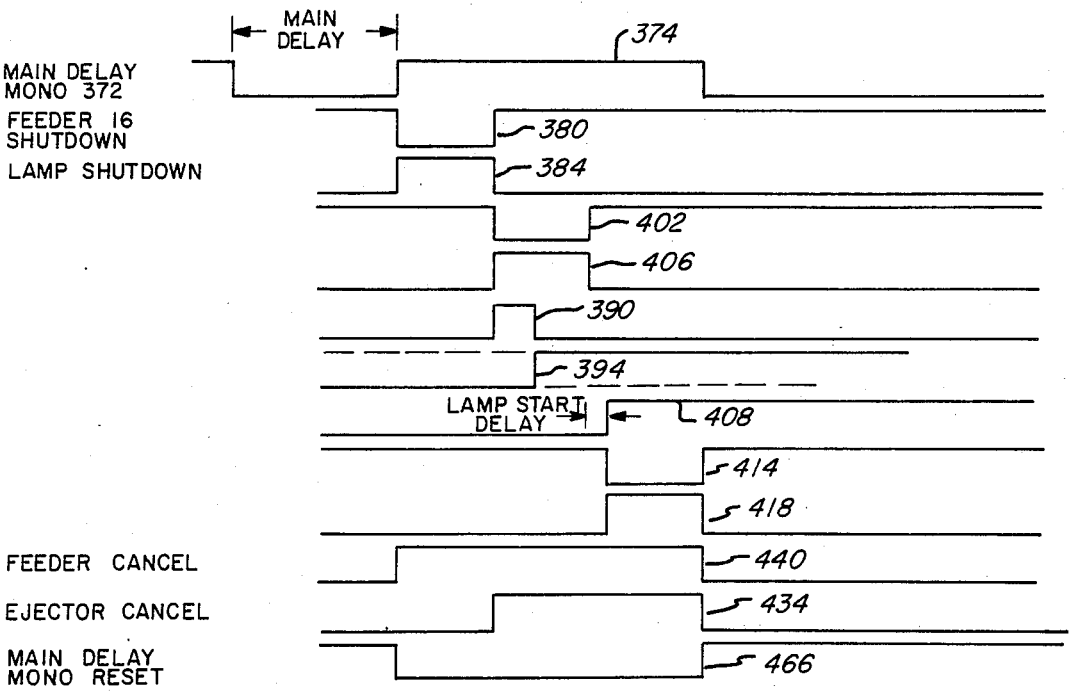

In the timing control circuit 78 (FIG. 17), a main delay monostable multivibrator or one-shot 372 forms an output pulse 374 (FIG. 23) after a time interval governed by a time control circuit 376. The main delay time interval is typically on the order of fifteen or twenty minutes, and represents the approximate time interval after which it becomes necessary to reverse the polarity of the current flowing through the lamp reversal contacts 316 (FIG. 18) to the lamps 42. The pulse 374 formed in main delay monostable 372 (FIG. 17) is furnished as an input signal to a further monostable multivibrator 378 which forms a feeder shutdown pulse waveform 380 (FIG. 23) on a conductor 382 and a lamp reverse pulse 384 on a conductor 386. A lamp reverse monostable multivibrator 388 (FIG. 17) forms a lamp reverse pulse 390 (FIG. 23) in response to the pulse 384 which is furnished to a bistable switch or toggle 392. Toggle 392 then changes states, as indicated by the waveform 394. The waveform 394 when transiting to a high level renders a transistor pair 396 conductive, allowing current to flow through a lamp reverse relay coil 398, causing the contacts 316 (FIG. 18) controlling the direction of current through the lamp 42 to change position. When the toggle 392 again transits to a low logic level, the transistor pair 396 is rendered nonconductive, interrupting the flow of current through the lamp reverse relay 398 and again causing the contacts 316 to change position. The pulse 384 formed in monostable 378 is also furnished as a input to a lamp shutdown monostable multivibrator 400, causing the monostable 400 to form a lamp shutdown pulse 402 over a conductor 404 and an opposite logic level pulse 406 which is furnished over the conductor 358 to the lamp current inhibit transistor 356 (FIG. 16), interrupting the flow of current through the lamps 42.

The lamp shutdown pulse 406 on the conductor 404 is furnished as an input to a NAND gate 407. The gate 407 also receives as an input the voltage condition on conductor 364 indicative of the conductive status of the lamp 42. As indicated by a waveform 408 (FIG. 23), after a short delay to allow all of the lamps 42 to become conductive after the change of state of the lamp shutdown pulse 402, the voltage level present on the conductor 364 provided to the Gate 407 transits to a high level. The waveform 408 on the conductor 364 is further provided as an input over a conductor 410 to a background blowdown monostable multivibrator or one-shot 412. Multivibrator 412 provides a pulse 414 (FIG. 23) over a conductor 416 to the gate 407 and a pulse 418 over a conductor 420 to a transistor 422. Transistor 422 on receipt of the pulse 418 renders transistors 424 and 426 conductive for the duration of the pulse 418 to power control board 275, permitting current to flow through the background blowdown solenoids 276 and 278 (FIG. 15), permitting bursts of air to be blown through the viewing stations V to cleanse them of any dust or other particles which may have accumulated.

NAND gate 407 is connected through an inverter gate 428, a low pass filter 430 and an inverter 432 to form an ejector cancel pulse 434 (FIG. 23) which causes a transistor 436 to become conductive, inhibiting the OR gate 108 in the delay circuit 64 (FIG. 12) for the duration of the ejector cancel pulse 434.

Figure 6:
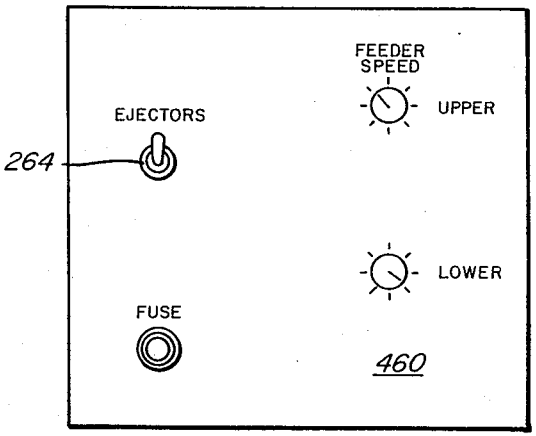
FIGS. 5, 6 and 7.are elevation views of instrument panels in the sorter of FIG. 1.

An inverted version of the pulse 434 (FIG. 23) is provided from the inverter 428 as an input to an NAND gate 438 (FIG. 17) which receives as its second input pulse 384 on conductor 382. The gate 438 forms a feeder cancel pulse 440 (FIG. 23) which after inversion in inverters 442 and 444 (FIG. 17) is furnished in parallel to NOR gates 446. The feeder cancel pulse 440 passes from gates 446 through inverter 448 to a pair of feeder cancel transistors 450. Transistors 450 over conductors 452 inhibit operation of the feeders 16 for the sorters U and L for the duration of the feeder cancel pulse 440. Each of feeder cancel transistors 450 is also connected through one of gates 446 to an inverter 454 to a feeder control switch 458 located on a feeder control panel 460 (FIG. 6) so that the operator may disable both the upper and lower feeders 16.

An inverter 460 (FIG. 17), a low pass filter 462 and another inverter 464 are electrically connected to the inverter 442 so that the feeder cancel pulse 440 from the gate 438 is provided in inverted form as a main delay monoreset pulse 466 (FIG. 23) over a conductor 468 (FIG. 17) as an input to main delay monostable 372. Pulse 466 resets monostable 372 on completion of the lamp reversal and, where used, chamber clearing functions performed under control of the timing control circuit 78.

A lamp reverse override switch 470 (FIGS. 5 and 17) is provided on the front panel 254. When depressed, the override switch 470 (FIG. 17) causes a monostable multivibrator 472 to form a pulse, causing the main delay monostable 372 to change states at a time earlier than its normal time of change of state. When this occurs, the chamber clearing and lamp reversal functions take place in response to the operator depressing switch 470 in the same manner as if the normal time delay of monostable 372 had expired.

In the operation of the present invention, the product to be sorted is fed into the hopper 10 and are formed into a number of parallel downwardly falling streams in the trays 14 and 18 before passing into the viewing station V. As has been set forth, these streams may have a number of individual grains adjacent each other and there is no need that they be separated into individual singly vertically spaced grains of product before being passed into the viewing station V.

In the viewing station V, the aligned photodiode cells in each of the optic viewing stations O sense a subdivided portion of the area of the viewing chamber V before the station O. The optical sensor photocells 34 form electrical signals indicative of the sensed light of the product, if any present before them. The signals from the optical sensor photocells 34 are sequentially electrically sampled or multiplexed by the multiplexer 90 for comparison with a reference signal in the comparator amplifier 104 of the classification circuit 62 to determine if the products are acceptable. If they are not, an output pulse 105 (FIG. 19) is formed, causing the monostable 110 to form a pulse 111 which passes through the delay circuit 64, emerging as a pulse 117 which is furnished to the ejector predrive circuit 66 and ejector drive circuit 68 to activate the solenoid 48, furnishing a burst of air through the ejector jet J in the viewing station V, blowing the unacceptable product into the chute 50 in the upper sorter U, from which it passes into feeder trays 14 and 18 of the lower sorter L where a similar sorting operation takes place. The acceptable product from the lower sorter L is fed from trays or chutes 52 into a suitable container. The unacceptable product from the lower sorter L is either discarded or furnished along with new, incoming grain into the chute or hopper 10 of the upper sorter U for further sorting.

During sorting operations, the intensity of the current flowing through the lamps 42 is continually monitored to determine if the rated current for each particular lamp is ever exceeded. If the rated current for one of the lamps 42 is exceeded, the alarm light emitting diode of diode pair 324 associated therewith is activated to indicate that rated current has been exceeded. The particular lamp 42 in question may then be replaced. In addition, during sorting operations, the illumination intensity output of each of the lamps 42 is compared against a reference level. In the event that the illumination level of a particular lamp varies from the reference level, the amount of current being furnished to the particular lamp 42 is adjusted to bring the illumination intensity output of the particular lamp 42 back to the reference level.

After a period of time set by main delay monostable 372, the feeder shut down pulse 384 and lamp shut down pulse 406 are formed and the polarity of current supplied to the fluorescent lamps 42 is reversed. Oscillator 336 is activated and furnishes pulses to pulse transformer circuits 346 for each of the lamps 42, furnishing such pulses until all of the lamps 42 are illuminated. At this point, sorting operations resume.

The foregoing disclosure and description of the invention are illustrative and explanatory thereof, and various changes in the size, shape and materials, components, circuit elements, wiring connections and contacts, as well as in the details of the illustrated circuitry and construction may be made without departing from the spirit of the invention.

I claim:

1. An apparatus for sorting agricultural products based on their color as they fall in plural parallel streams through an illuminated viewing chamber, comprising:

(a) light source means for illuminating the viewing chamber and the products passing therethrough;

(b) plural optical station means in the viewing chamber for sensing the light reflected from the products as they pass through the viewing chamber and the illumination level of the viewing chamber at positions unaffected by the product streams;

(c) each of said optical station means comprising a plurality of aligned optical sensors for sensing the light reflected from the products in one of the streams and forming electrical signals indicative of the sensed light and a further aligned optical sensor for sensing the illumination level of the optical station means at a position unaffected by products of such one stream and forming an electrical signal indicative of sensed illumination level;

(d) means for sequentially sampling the electrical signals from said optical sensors in said optical station means;

(e) processing circuit means for comparing the sequentially sampled electrical signals indicative of reflected light with a reference signal to determine if the products are acceptable;

(f) said processing circuit means including amplification means for amplifying the signals formed by said product light reflection optical sensors, the gain of said amplification means controlled by the signal formed by said illumination level optical sensor; and (g) ejector means for ejecting unacceptable products from those determined acceptable.

2. The apparatus of claim 1, wherein said light source means comprises:

fluorescent lamp means.

3. The apparatus of claim 2, further including:

power supply means for supplying electrical energy to said fluorescent lamp means; and means for periodically reversing the polarity of electrical energy supplied to said fluorescent lamp means by said power supply means.

4. The apparatus of claim 1, further including:

means for sensing the level of current flowing through said light source means.

5. The apparatus of claim 4, further including:

means for forming a reference signal indicative of the maximum rated current for said light source means;

means for comparing the reference signal with the level of current sensed by said means for sensing current level; and means for indicating when the sensed level of current exceeds the reference signal.

6. The apparatus of claim 1, further including:

means for sensing the intensity of illumination from said light source means, said light source illumination sensing means located near said light source means.

7. The apparatus of claim 6, further including:

means for forming an illumination level signal indicative of the desired illumination intensity from said light source means;

means for comparing the illumination level signal with the illumination intensity sensed by said means for sensing illumination intensity; and means for adjusting the sensed illumination intensity to equal the desired illumination intensity.

8. The apparatus of claim 1, further including:

background illumination means for forming a background illumination reference level of light in the viewing chamber.

9. The apparatus of claim 8, further including:

means for sensing the intensity of illumination from said background illumination means, said background illumination sensing means located near said background illumination means.

10. The apparatus of claim 9, further including:

means for forming an illumination level signal indicative of the desired illumination intensity from said background illumination means;

means for comparing the illumination level signal with the illumination intensity sensed by said means for sensing illumination intensity; and means for adjusting the sensed illumination intensity to equal the desired illumination intensity.

11. The apparatus of claim 1, wherein said means for sequentially sampling comprises:

multiplexer means for sequentially electrically connecting said plurality of aligned optical sensors for a scanning interval to said processing circuit means.

12. The apparatus of claim 11, wherein said multiplexer means forms switching transients in sequentially electrically connecting said plurality of aligned optical sensors, and further including:

means for inhibiting comparison in said processing circuit means for an initial portion of the scanning interval to prevent switching transients from being sensed as unacceptable products.

13. An apparatus for sorting agricultural products based on their color as they fall in a stream through an illuminated viewing chamber, comprising:

(a) optical station means in the viewing chamber for sensing the light reflected from the products as they pass through the viewing chamber and the illumination level of the viewing chamber at a position unaffected by the products;

(b) light source means for illuminating the viewing chamber and the products passing therethrough;

(c) said optical station means comprising a plurality of aligned optical sensors for sensing the light reflected from the products and forming electrical signals indicative of the sensed light and a further aligned optical sensor for sensing the illumination level of the optical station means at a position unaffected by the products and forming an electrical signal indicative of the sensed illumination level;

(d) processing circuit means for comparing the electrical signals indicative of reflected light with a reference signal to determine if the products are acceptable;

(e) said processing circuit means including amplification means for amplifying the signal formed by said product light reflection optical sensors, the gain of said amplification means controlled by the signal formed by said illumination level optical sensor; and (f) ejector means for ejecting unacceptable products from those determined acceptable.

14. The apparatus of claim 13, wherein said light source means comprises:

fluorescent lamp means.

15. The apparatus of claim 14, further including:

power supply means for supplying electrical energy to said fluorescent lamp means; and means for periodically reversing the polarity of electrical energy supplied to said fluorescent lamp means by said power supply means.

16. The apparatus of claim 13, further including:

means for sensing the level of current flowing through said light source means.

17. The apparatus of claim 16, further including:

means for forming a reference signal indicative of the maximum rated current for said light source means;

means for comparing the reference signal with the level of current sensed by said means for sensing current level; and means for indicating when the sensed level of current exceeds the reference signal.

18. The apparatus of claim 13, further including:

means for sensing the intensity of illumination from said light source means, said light source illumination sensing means located near said light source means.

19. The apparatus of claim 18, further including:

means for forming an illumination level signal indicative of the desired illumination intensity from said light source means;

means for comparing the illumination level signal with the illumination intensity sensed by said means for sensing illumination intensity; and means for adjusting the sensed illumination intensity to equal the desired illumination intensity.

20. The apparatus of claim 13, further including:

background illumination means for forming a background illumination reference level of light in the viewing chamber.

21. The apparatus of claim 20, further including:

means for sensing the intensity of illumination from said background illumination means, said background illumination sensing means located near said background illumination means.

22. The apparatus of claim 21, further including:

means for forming an illumination level signal indicative of the desired illumination intensity from said background illumination means;

means for comparing the illumination level signal with the illumination intensity sensed by said means for sensing illumination intensity; and means for adjusting the sensed illumination intensity to equal the desired illumination intensity.

* * * * *